US007934359B2

(12) United States Patent
Ghini et al.

(10) Patent No.: US 7,934,359 B2
(45) Date of Patent: May 3, 2011

(54) BLANK FOR PRODUCING A RIGID PACKAGE FOR TOBACCO ARTICLES

(75) Inventors: Marco Ghini, Monte San Pietro (IT); Roberto Polloni, Modigliana (IT); Stefano Negrini, Calderara di Reno (IT)

(73) Assignee: G.D Societa' per Azioni, Bologna (IT)

( * ) Notice: Subject to any disclaimer, the term of this patent is extended or adjusted under 35 U.S.C. 154(b) by 635 days.

(21) Appl. No.: 12/018,309

(22) Filed: Jan. 23, 2008

(65) Prior Publication Data

US 2008/0190791 A1 Aug. 14, 2008

(30) Foreign Application Priority Data

Jan. 24, 2007 (IT) ..... BO2007A0038

(51) Int. Cl.
*B65B 11/00* (2006.01)

(52) U.S. Cl. ..... 53/461; 53/466; 493/162; 206/268; 229/160.1; 229/223

(58) Field of Classification Search ..... 53/228, 53/461, 466; 493/52, 162, 910; 206/268, 206/273; 229/122.32, 160.1, 223
See application file for complete search history.

(56) References Cited

U.S. PATENT DOCUMENTS 4,903,844 A 2/1990 Oglesby
5,460,321 A 10/1995 Focke et al.
6,742,652 B1 6/2004 Focke et al.
6,854,243 B2 * 2/2005 Sendo et al. ..... 53/234
7,240,469 B2 * 7/2007 Ghini et al. ..... 53/466
7,827,769 B2 * 11/2010 Bertuzzi et al. ..... 53/466
2003/0183541 A1 10/2003 Draghetti et al.

FOREIGN PATENT DOCUMENTS

GB 948790 2/1964
WO WO-2005/115852 12/2005

OTHER PUBLICATIONS

European Search Report in EP 08 15 0522 dated Apr. 3, 2008.

* cited by examiner

*Primary Examiner* — Thanh K Truong
(74) *Attorney, Agent, or Firm* — Marshall, Gerstein & Borun LLP

(57) ABSTRACT

A blank for producing a package of tobacco articles; the package of tobacco articles has a group of tobacco articles wrapped in a tubular inner sheet of packing material closed axially by two end folds, and an outer package, which is formed by folding the blank, surrounds the group of tobacco articles, is parallelepiped-shaped, and has a top wall contacting a first end fold of the inner sheet of packing material, a bottom wall contacting a second end fold of the inner sheet of packing material, and a number of lateral walls; and the blank has two transverse fold lines, and a number of longitudinal fold lines defining, between the two transverse fold lines, a first panel forming part of a first minor lateral wall, a second panel forming a first major lateral wall, a third panel forming a second minor lateral wall, a fourth panel forming a second major lateral wall, and a fifth panel forming the rest of the first minor lateral wall.

12 Claims, 48 Drawing Sheets

BLANK FOR PRODUCING A RIGID PACKAGE FOR TOBACCO ARTICLES

CROSS-REFERENCE TO RELATED APPLICATIONS

This application claims the benefit of Italian patent application No. BO2007A 000038, filed Jan. 24, 2007.

TECHNICAL FIELD

The present invention relates to a blank for producing a rigid package for tobacco articles.

The present invention advantageously applies, for example, to a blank for producing a rigid, hinged-lid packet of cigarettes, to which the following description refers purely by way of example.

BACKGROUND ART

Rigid, hinged-lid packets of cigarettes are currently the most marketed, by being easy to produce and easy and practical to use, and by effectively protecting the cigarettes inside.

A rigid, hinged-lid packet of cigarettes comprises a group of cigarettes wrapped in a sheet of foil; and a rigid outer package housing the group of cigarettes. The outer package comprises a cup-shaped container housing the group of cigarettes and having an open top end; and a cup-shaped lid hinged to the container along a hinge to rotate, with respect to the container, between an open position and a closed position respectively opening and closing the open end. A collar is normally folded and fitted inside the container to project partly outwards of the open end and engage a corresponding inner surface of the lid when the lid is in the closed position.

A rigid, hinged-lid packet of cigarettes has recently been proposed, in which the hinge is parallel to a minor transverse edge.

On some existing packing machines, the ends of the inner and outer sheets of packing material are folded together onto the group of cigarettes. On packing machines of this sort, standard blanks for packets of the type proposed cannot be used, on account of part of the inner sheet of packing material being "caught" between the end tabs of the blank (i.e. of the outer sheet of packing material) when folding the ends of the inner sheet of packing material and the blank, so that, the first time the lid is opened, portions of the inner sheet of packing material are lifted with the lid, thus altering the fold of the inner sheet of packing material and seriously impairing the look of the inside of the packet of cigarettes.

Moreover, as compared with a standard packet hinged parallel to a major transverse edge, a packet of the type proposed has a much larger collar. Consequently, producing packets of the type proposed on an existing packing machine designed to produce standard packets may pose problems (i.e. cost problems, because of the number of alterations involved) on account of the larger size of the collars of packets hinged parallel to a minor transverse edge. One possible solution to the collar size problem is to use a blank with a built-in the collar. That is, the collar may be connected to the main body of the blank (normally by the blank manufacturer) before being fed to the packing machine, so that the blanks fed to the packing machine are each fitted with a respective collar glued into the correct position.

In the most common embodiment, a blank with a built-in collar comprises a main body for forming the outer package; and an end appendix for forming the collar, and which is connected to the main body of the blank by at least one connecting panel, so the collar can be folded and glued to the main body of the blank before being fed to the packing machine.

Patent Application EPO671342A1 describes a carton of cigarettes identical in design to a rigid, hinged-lid packet of cigarettes, and formed from a blank with a built-in collar, i.e. a blank comprising an end appendix defining the collar and connected to the main body of the blank by at least one connecting panel. More specifically, the blank comprises a front wall connected at one end to a front wall of the lid along a fold line, and at the other to a tab; and a T-shaped appendix is connected to an intermediate portion of a free edge of the tab, and is folded onto the front wall of the container to define the collar.

Patent Application US2004050726A1 describes a carton of cigarettes identical in design to a rigid, hinged-lid packet of cigarettes, and formed from a blank with a built-in collar. The blank has a printed face and a nonprinted face, and comprises a main portion defining the container and lid of the carton; and an end appendix, which defines the collar, and comprises a first portion, and two connecting arms having, at opposite ends, a first and second fold line hinging the main portion and the first portion respectively. The blank is folded by rotating the arms about the respective first fold lines so that the arms adhere to the main portion; and, when rotating the arms, rotating the first portion of the appendix about the respective second fold lines, so that the printed face of the first portion adheres to the nonprinted face of the main portion, and the printed surface of the collar shows outwards when the carton is assembled.

Patent Application US2004035722A1 describes a carton of cigarettes identical in design to a rigid, hinged-lid packet of cigarettes, and formed from a blank with a built-in collar. The blank comprises, aligned along a first axis, a central panel; two lateral panels alongside the central panel; an end panel; and an appendix aligned with the central panel along a second axis perpendicular to the first axis, connected to the central panel, and for forming the lid. The collar forms part of the container, and is formed by deformation by embossing a given portion of the front wall of the container, and respective given portions of the lateral walls of the container.

Patent Application WO2005115852A1 describes a carton of cigarettes identical in design to a rigid, hinged-lid packet of cigarettes, and formed from a blank with a built-in collar. In various embodiments, the carton of cigarettes may resemble a standard packet of cigarettes or a packet of cigarettes hinged parallel to a minor transverse edge. The collar is connected to the main body of the blank by a U-shaped connecting member, and is folded into the finish position by two consecutive folding operations about a first transverse fold line and a second longitudinal fold line. More specifically, the collar is connected along the second longitudinal fold line to the connecting member, and the connecting member is connected by the first transverse fold line to the main body of the blank.

DISCLOSURE OF THE INVENTION

It is an object of the present invention to provide a blank for producing a rigid package for tobacco articles, which blank is designed to eliminate the aforementioned drawbacks, while at the same time being cheap and easy to produce.

According to the present invention, there is provided a blank for producing a rigid package for tobacco articles, as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
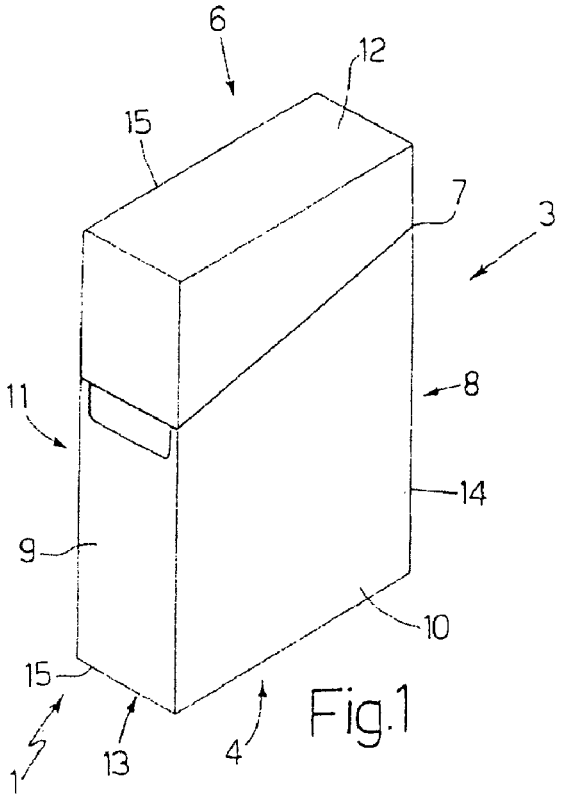
FIG. 1 shows a front view in perspective of a rigid packet of cigarettes produced in accordance with the present invention and in a closed configuration.
Figure 2:
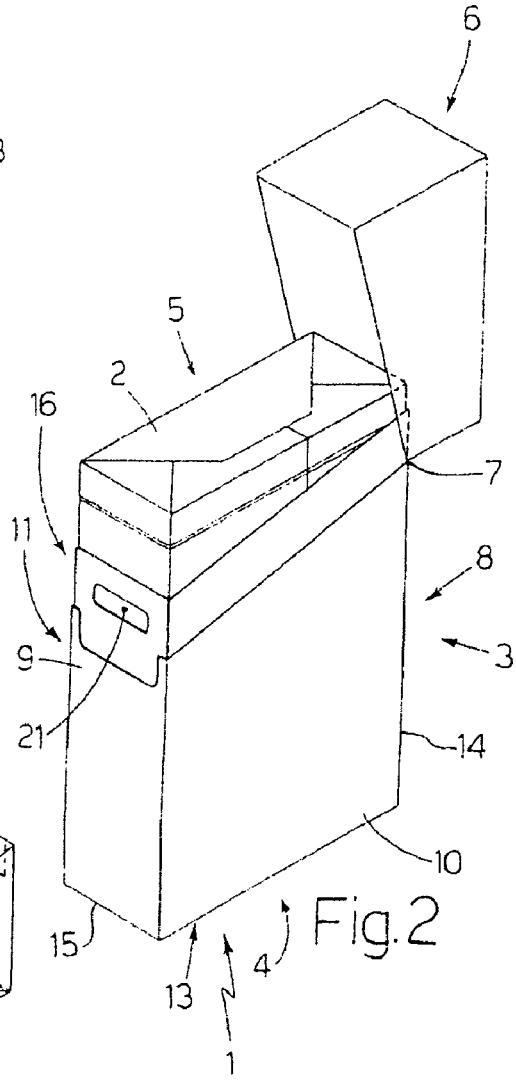
FIG. 2 shows a front view in perspective of the FIG. 1 rigid packet of cigarettes in an open configuration.
Figure 3:
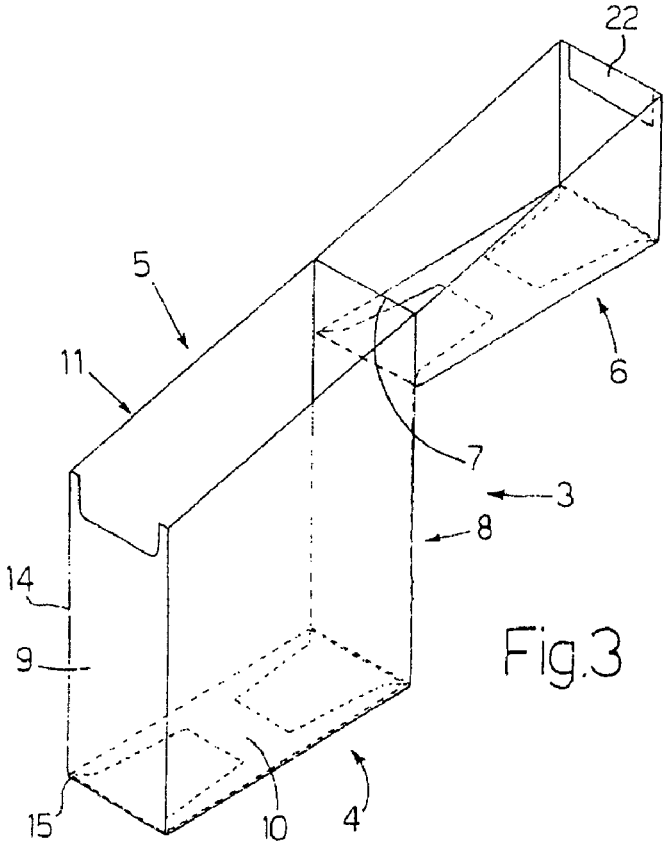
FIG. 3 shows a front view in perspective of an outer package of the FIG. 1 rigid packet of cigarettes in an open configuration.

In FIGS. 1-4, number 1 indicates as a whole a rigid packet of cigarettes comprising a group 2 of cigarettes wrapped in a sheet of foil; and a rigid outer package 3 housing group 2 of cigarettes. Outer package 3 comprises a cup-shaped container 4 (shown on its own in FIG. 3) having an open top end 5; and a cup-shaped lid 6 hinged to container 4 along a hinge 7 to rotate, with respect to container 4, between an open position (FIG. 2) and a closed position (FIG. 1) opening and closing open top end 5 respectively.

Lid 6 preferably varies in height, which is minimum at hinge 7; and the height of container 4 is obviously complementary to that of lid 6, and is therefore maximum at hinge 7.

When lid 6 is in the closed position, outer package 3 is in the form of a rectangular-section parallelepiped, and comprises two parallel opposite minor lateral walls 8 and 9; two parallel opposite major lateral walls 10 and 11; a top wall 12; and a bottom wall 13 opposite and parallel to top wall 12. Lateral walls 8, 9, 10, 11 are obviously perpendicular to top and bottom walls 12, 13, and minor lateral walls 8, 9 are smaller than major lateral walls 10, 11.

Hinge 7 of lid 6 is located on minor lateral wall 8, which therefore also defines a rear wall of outer package 3, while minor lateral wall 9 defines a front wall of outer package 3.

Outer package 3 has four longitudinal edges 14 defined between lateral walls 8, 9, 10, 11; and eight transverse edges 15 defined between top and bottom walls 12, 13 and lateral walls 8, 9, 10, 11.

Packet 1 of cigarettes also comprises a collar 16 (shown on its own in FIG. 4), which is tubular, is folded into a tube about group 2 of cigarettes, between group 2 of cigarettes and outer package 3, and projects partly from open top end 5 of container 4 to engage an inner surface of lid 6 when lid 6 is in the closed position.

Figure 4:
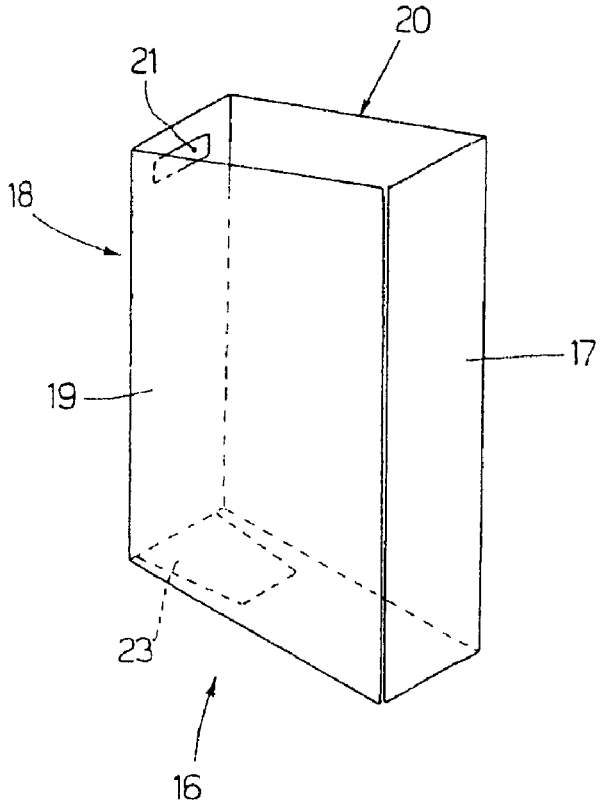
FIG. 4 shows a rear view in perspective of a collar of the FIG. 1 rigid packet of cigarettes.

As shown in FIG. 4, collar 16 comprises a minor lateral wall 17, which is positioned contacting an inner surface of minor lateral wall 8 of outer package 3; a minor lateral wall 18, which is positioned contacting an inner surface of minor lateral wall 9 of outer package 3; a major lateral wall 19, which is positioned contacting an inner surface of major lateral wall 10 of outer package 3; and a major lateral wall 20, which is positioned contacting an inner surface of major lateral wall 11 of outer package 3.

One function of collar 16 is to keep lid 6 in the closed position by making it necessary to apply a certain amount of force to open lid 6. For which purpose, the front wall 18 of collar 16 has a horizontal slit 21; and lid 6 has a tab 22 (shown in FIG. 3), which projects inwards of lid 6 and, when lid 6 is in the closed position, releasably engages slit 21 to retain lid 6 in the closed position.

In one possible embodiment, to improve the stability of packet 1 of cigarettes, collar 16 has at least one bottom tab 23 positioned contacting bottom wall 13 of outer package 3 (i.e. located between a bottom wall of group 2 of cigarettes and bottom wall 13 of outer package 3), and which may be glued to bottom wall 13.

Figure 5:
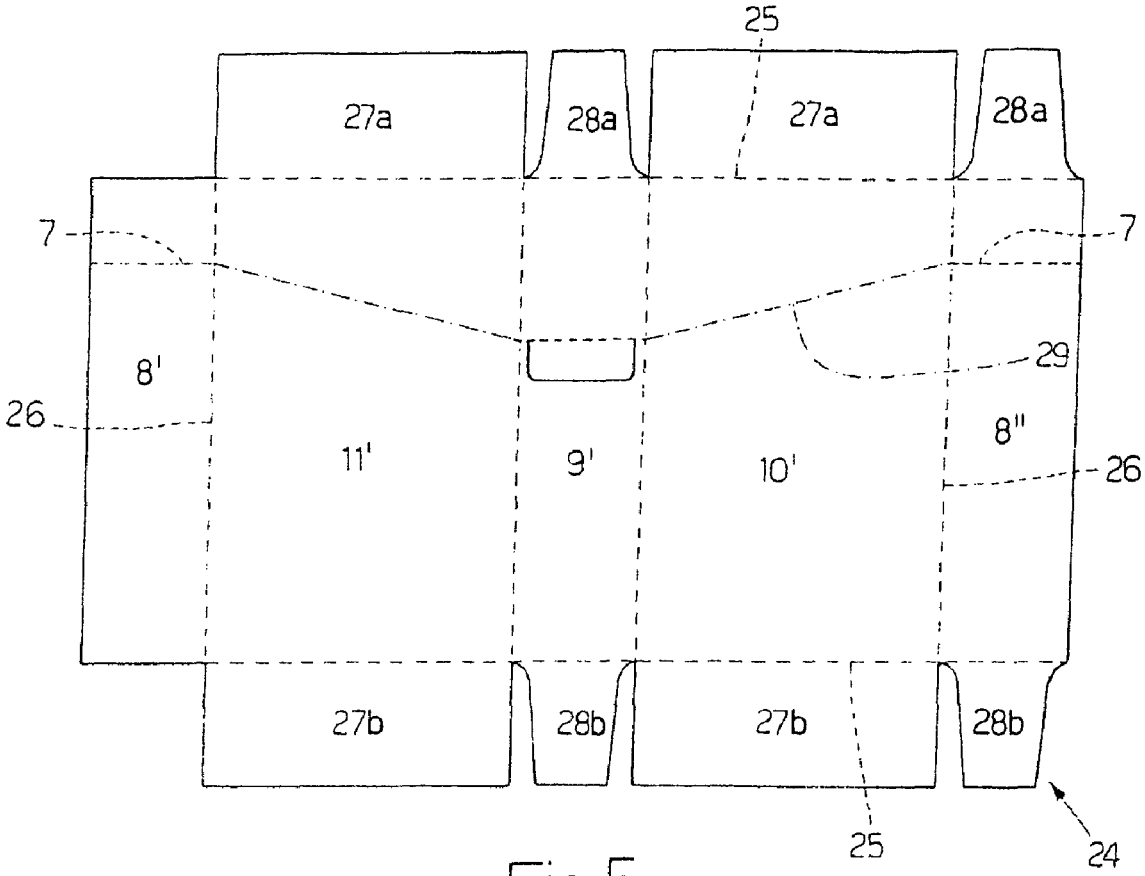
FIG. 5 shows a plan view of a flat blank by which to form an outer package of the rigid packet of cigarettes in FIGS. 1-4.

Outer package 3 of rigid packet 1 of cigarettes is formed by folding a blank 24 shown flat in FIG. 5, in which the parts of blank 24 are indicated, where possible, using the same reference numbers, with superscripts, as for the corresponding parts of outer package 3.

Blank 24 comprises two transverse fold lines 25, and a number of longitudinal fold lines 26 defining, between the two transverse fold lines 25, a panel 8' defining an inner portion of minor lateral wall 8; a panel 11' defining major lateral wall 11; a panel 9' defining minor lateral wall 9; a panel 10' defining major lateral wall 10; and a panel 8" defining an outer portion of minor lateral wall 8 when superimposed on and glued to panel 8'.

Panels 10' and 11' each comprise two major tabs 27, which are located at opposite ends of panel 10', 11', are separated from panel 10', 11' by the two transverse fold lines 25, and form part of top wall 12 and bottom wall 13 respectively. More specifically, of each panel 10', 11', a major tab 27*a* forms part of top wall 12, and a major tab 27*b* forms part of bottom wall 13.

Panels 9' and 8" each comprise two minor tabs 28, which are located at opposite ends of panel 9', 8", are separated from panel 9', 8" by the two transverse fold lines 25, and form part of top wall 12 and bottom wall 13 respectively. More specifically, of each panel 9', 8", a minor tab 28*a* forms part of top wall 12, and a minor tab 28*b* forms part of bottom wall 13.

Blank 24 also comprises a substantially transverse tear line 29 separating container 4 and lid 6. In other words, lid 6 is initially joined to container 4 along tear line 29, and is detached from container 4 by the user tearing along tear line 29 when unsealing packet 1 of cigarettes.

Figure 6:
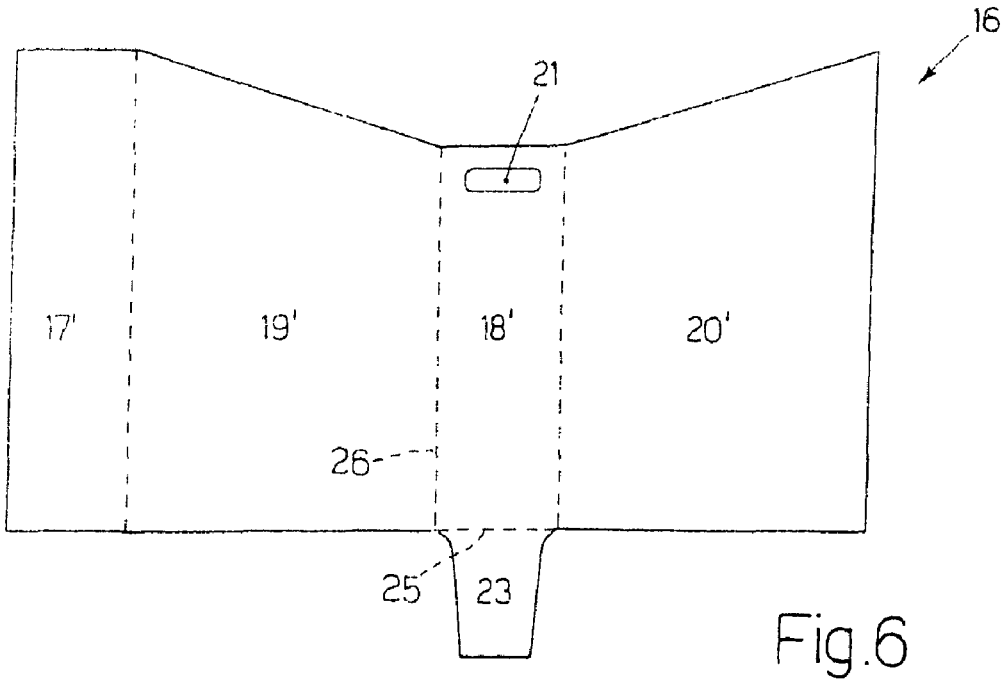
FIG. 6 shows a plan view of a flat collar of the rigid packet of cigarettes in FIGS. 1-4.
Figure 8:
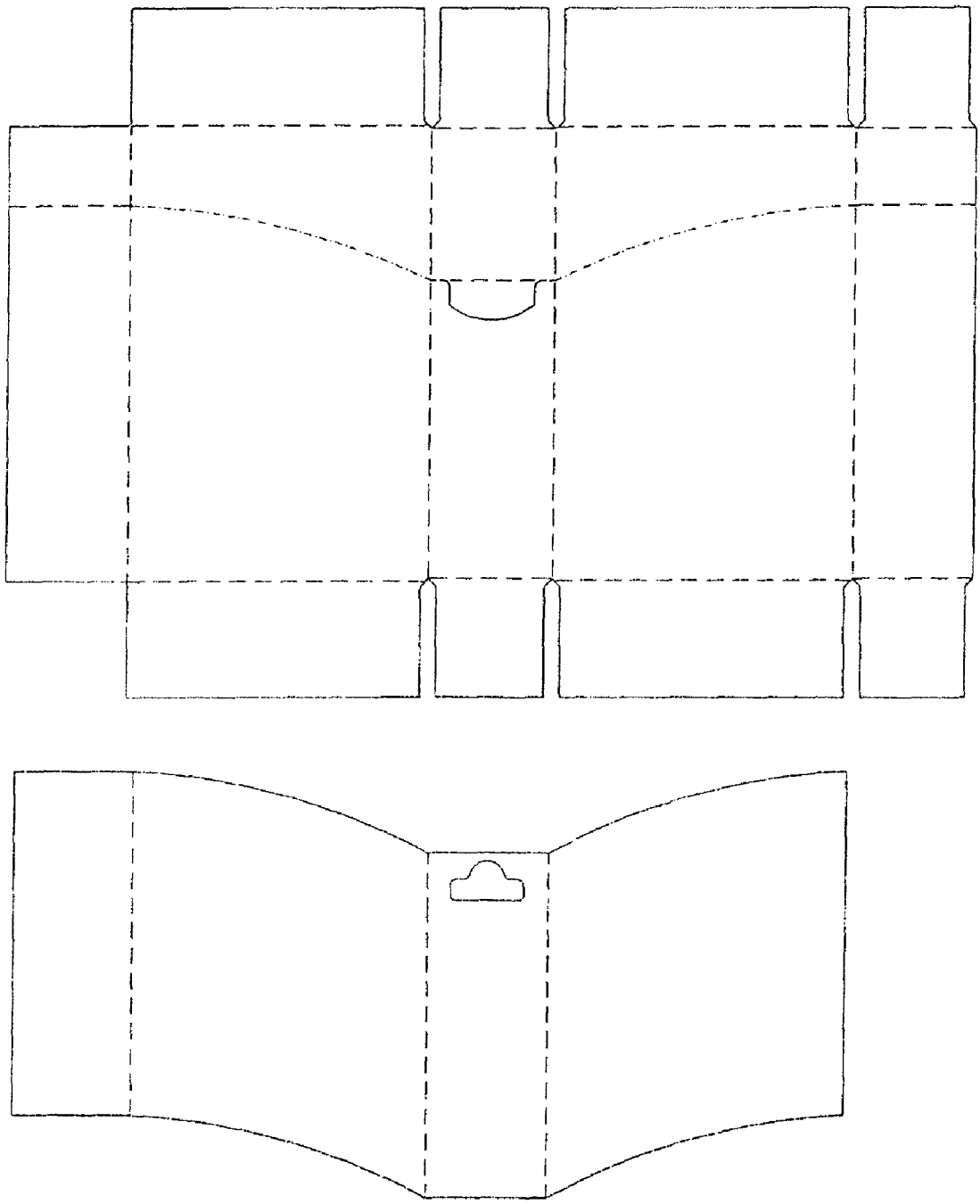
FIGS. 8-30 show plan views of various embodiments of blanks and respective collars.
Figure 9:
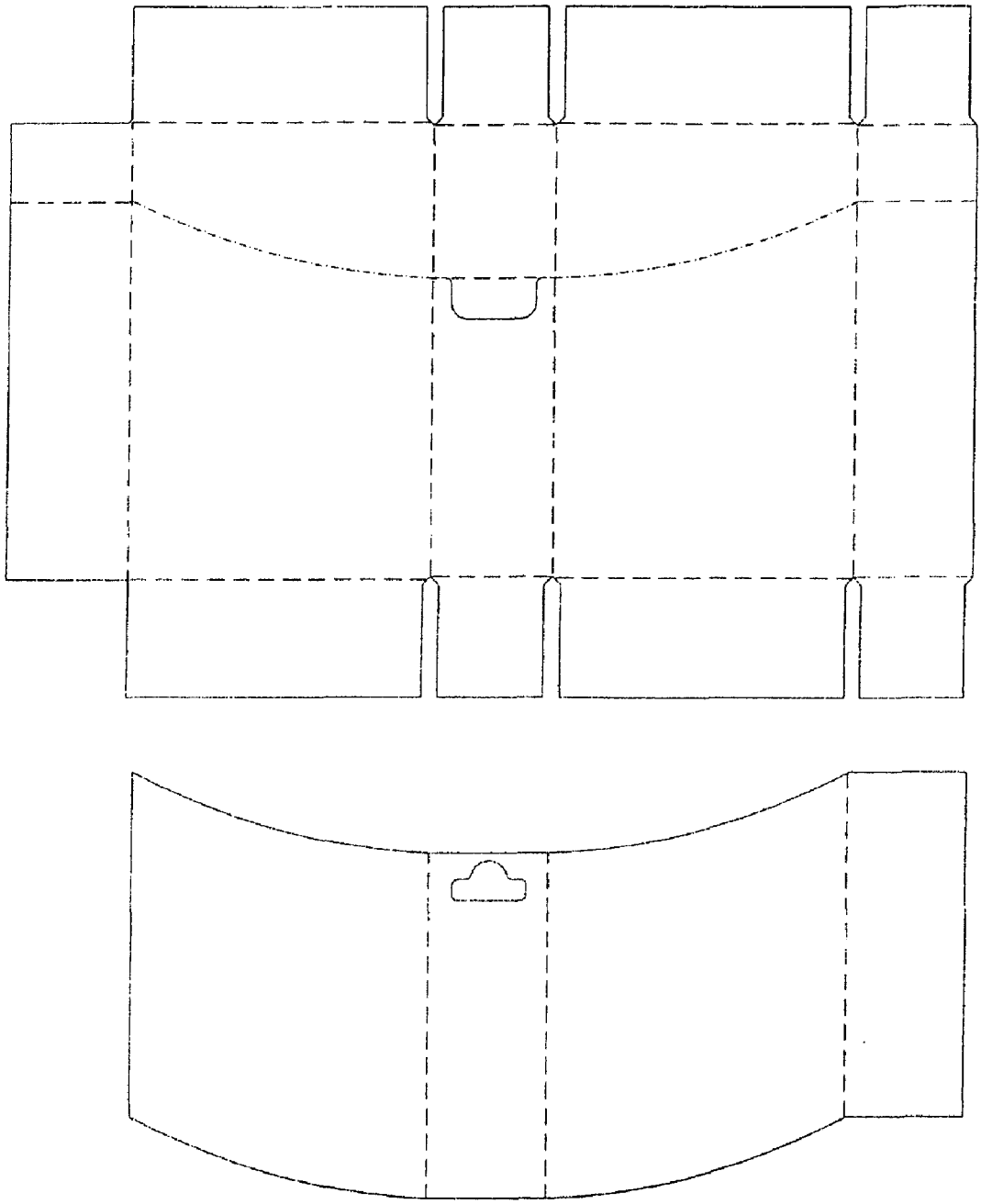
Figure 10:
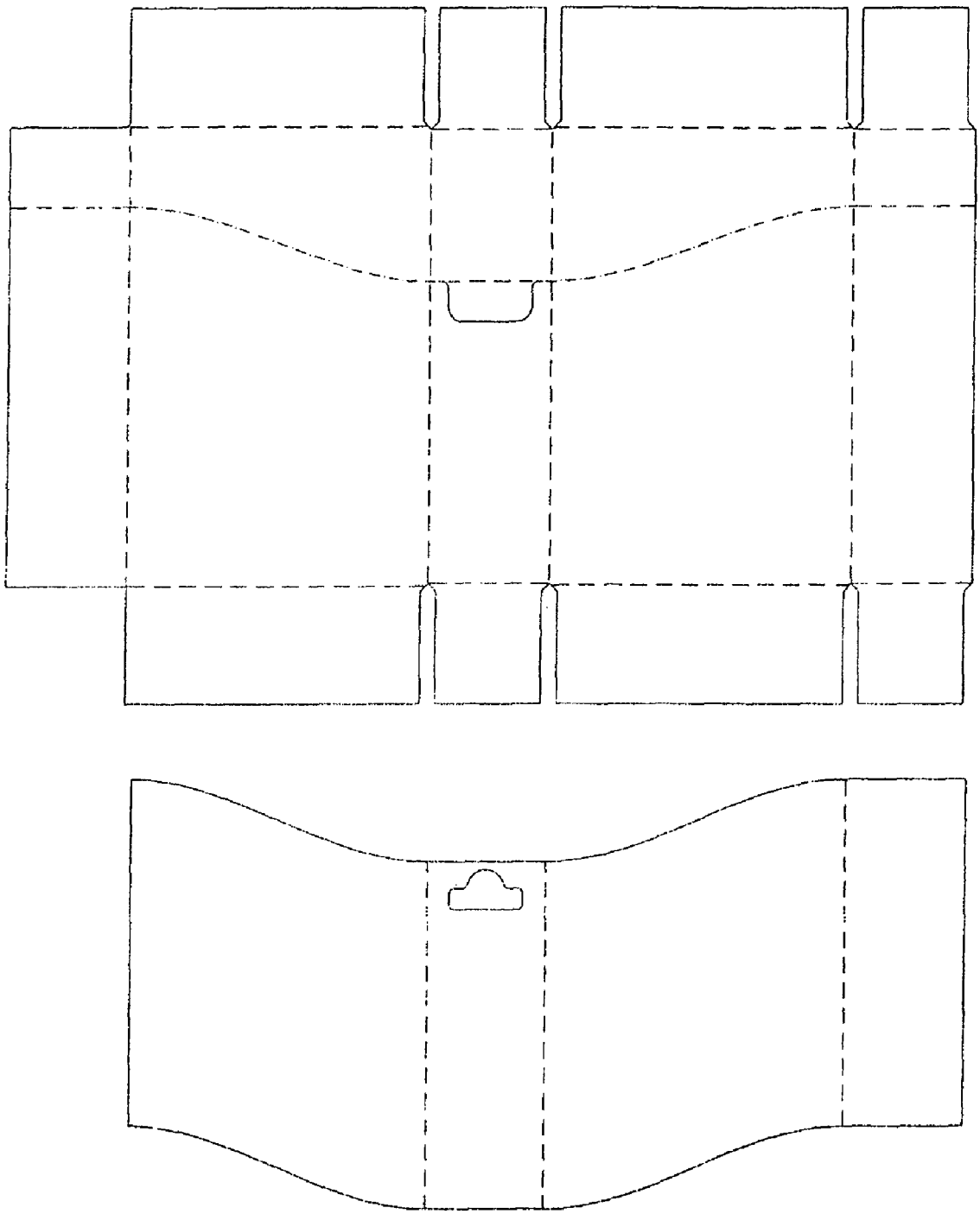
Figure 11:
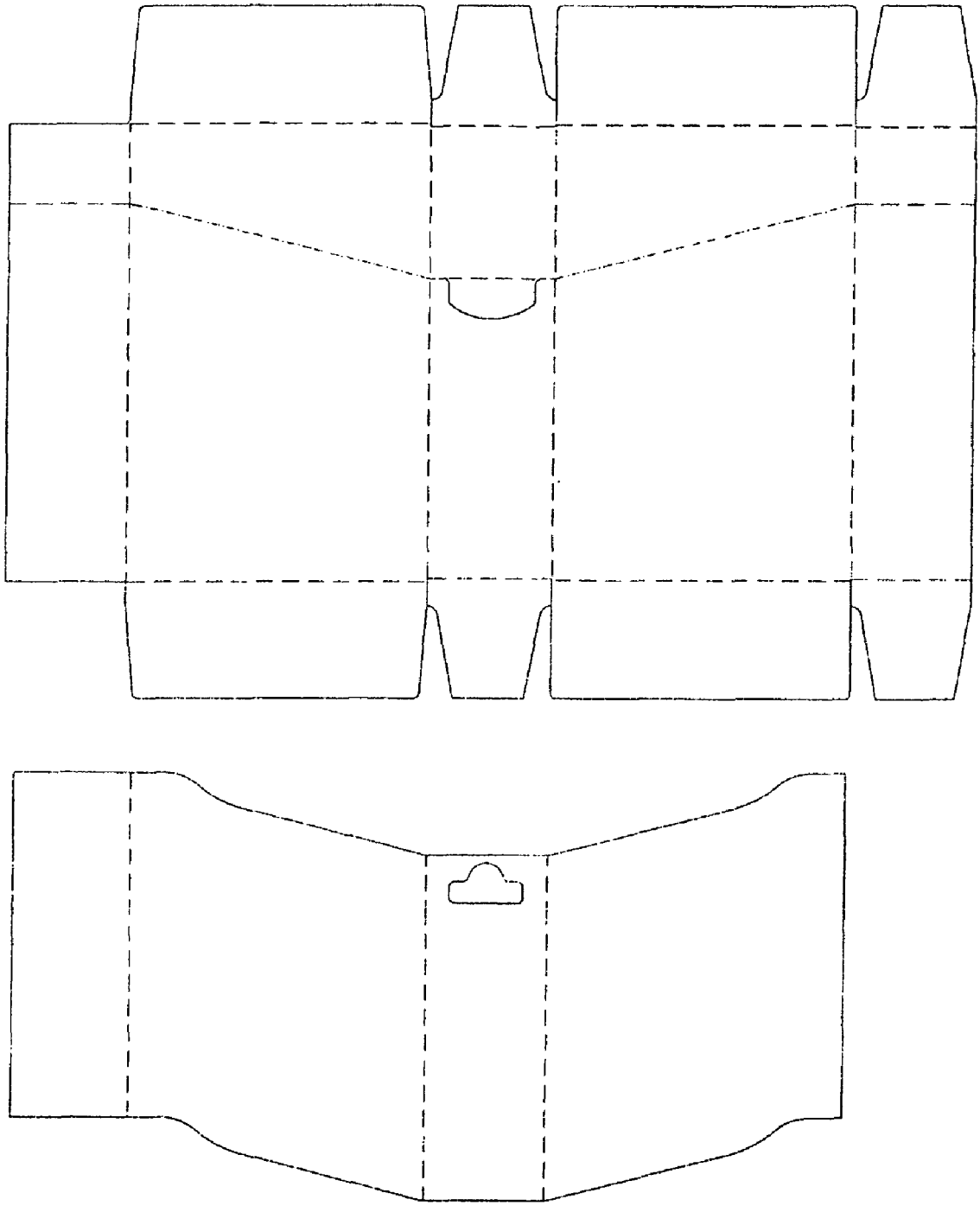
Figure 12:
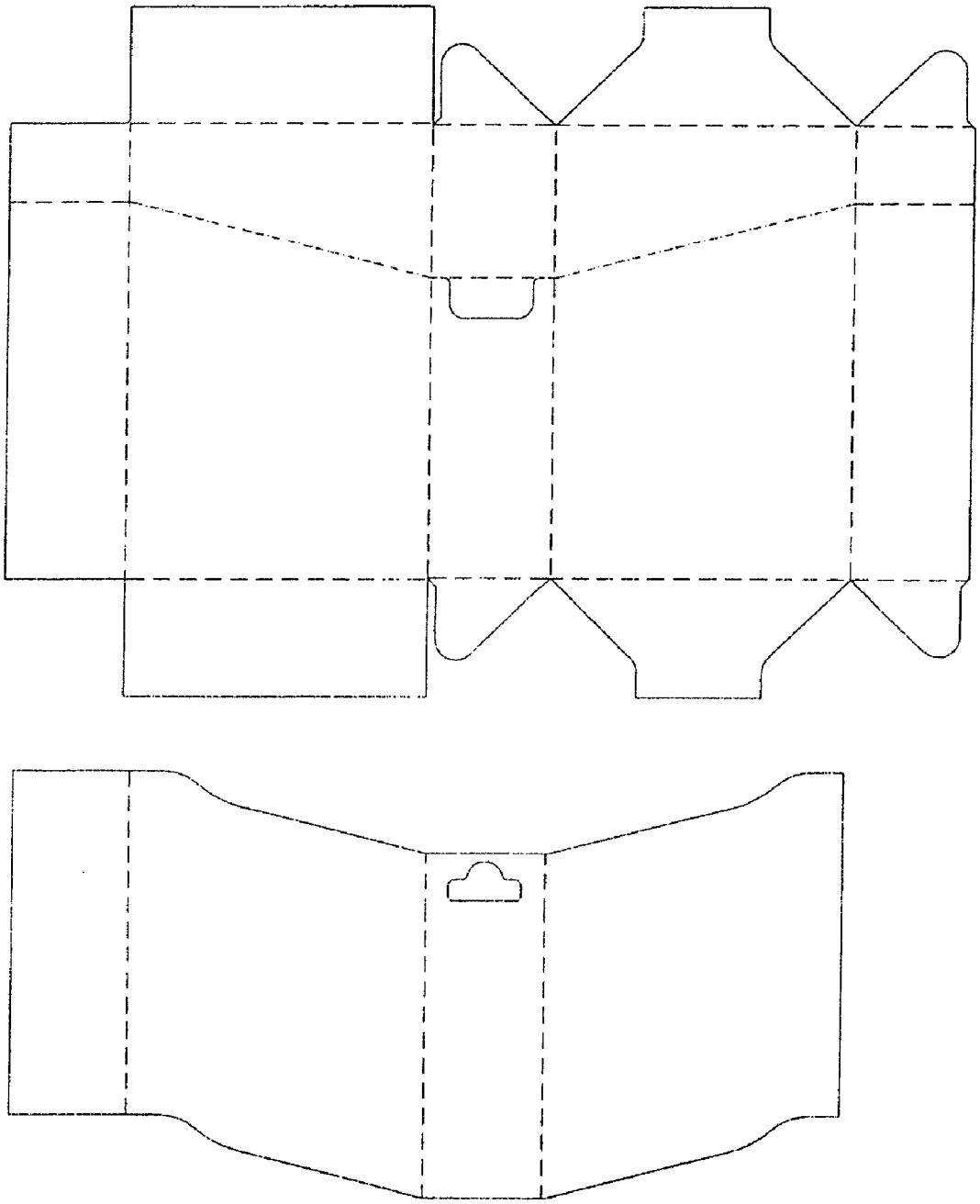
Figure 13:
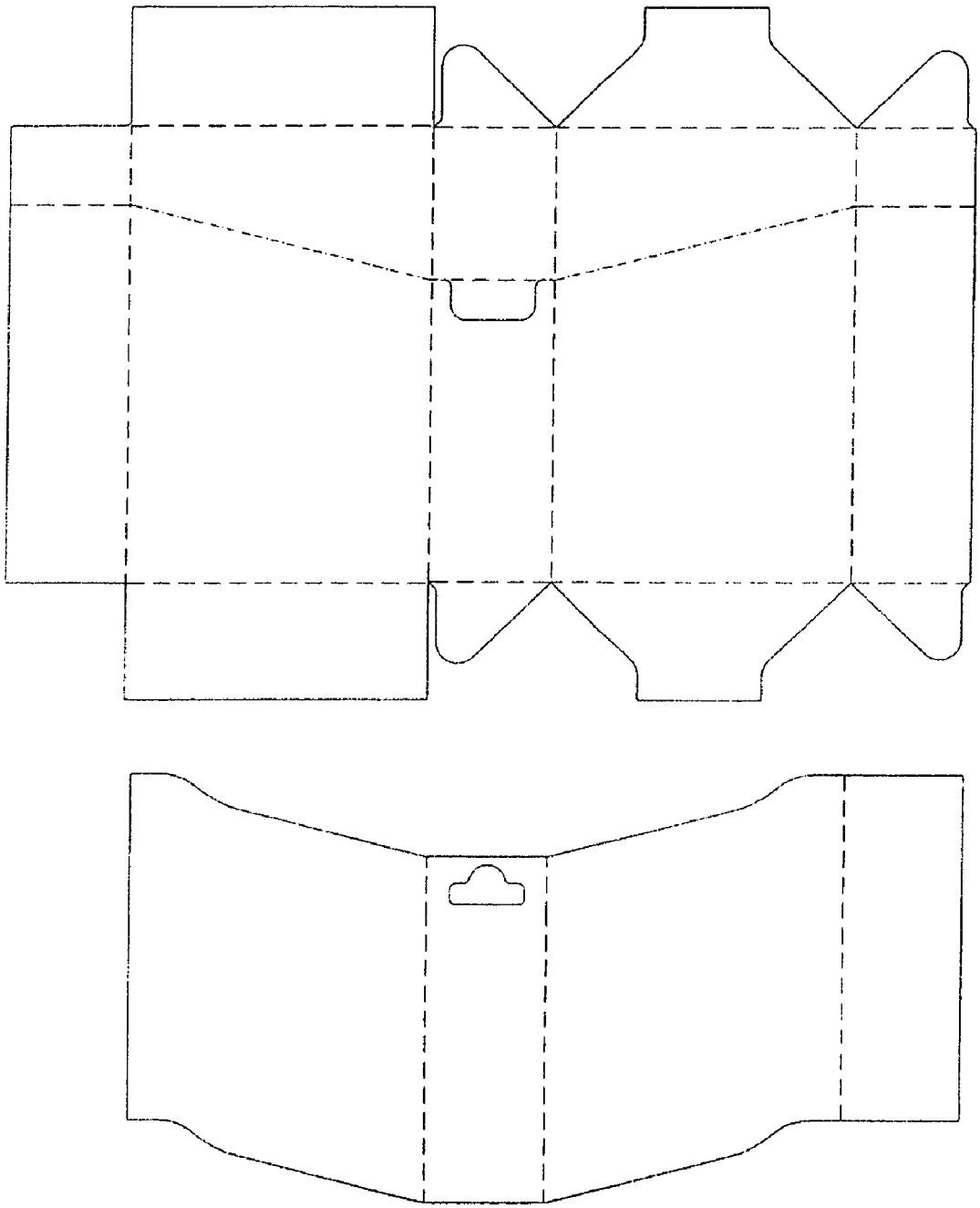
Figure 14:
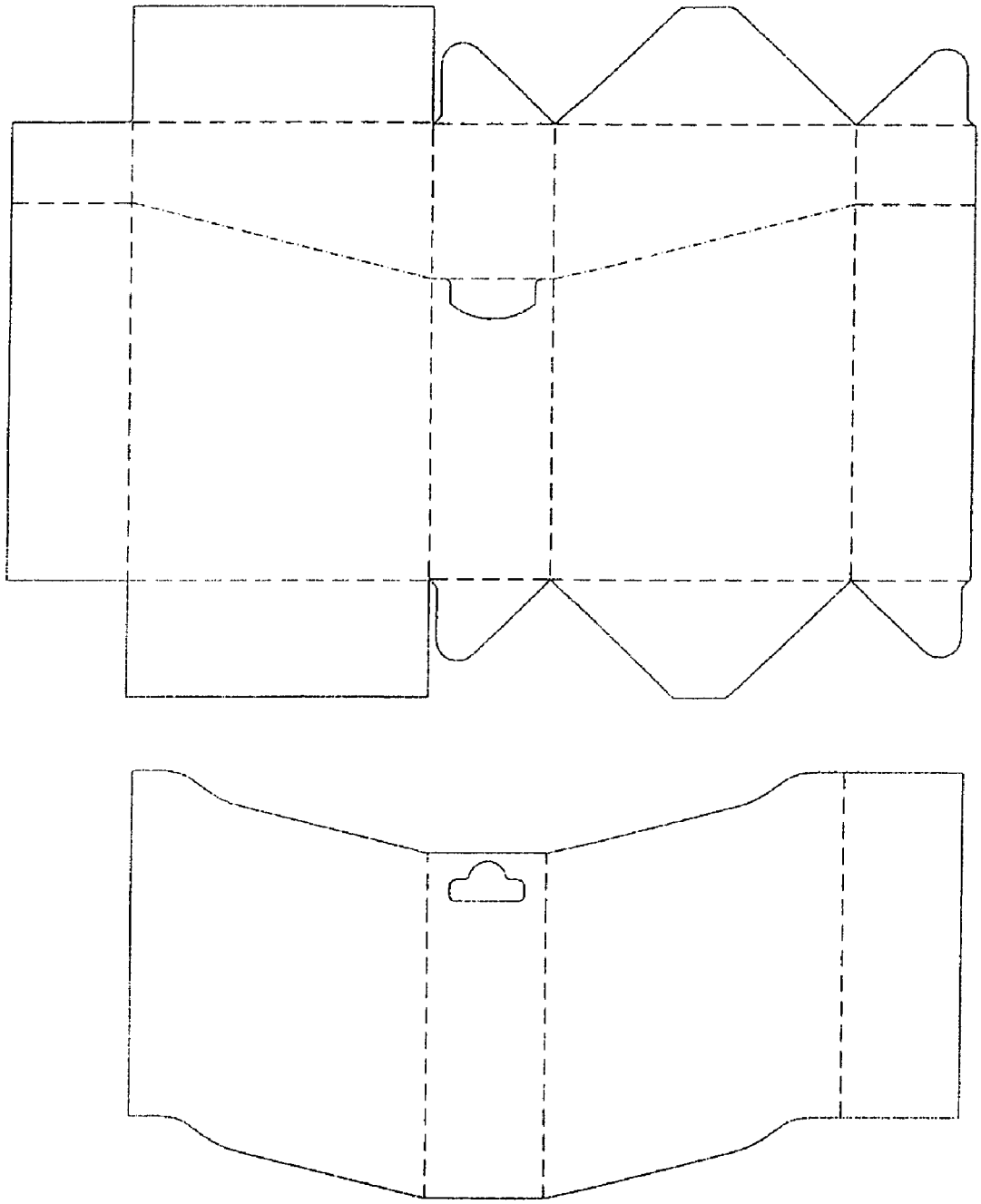
Figure 15:
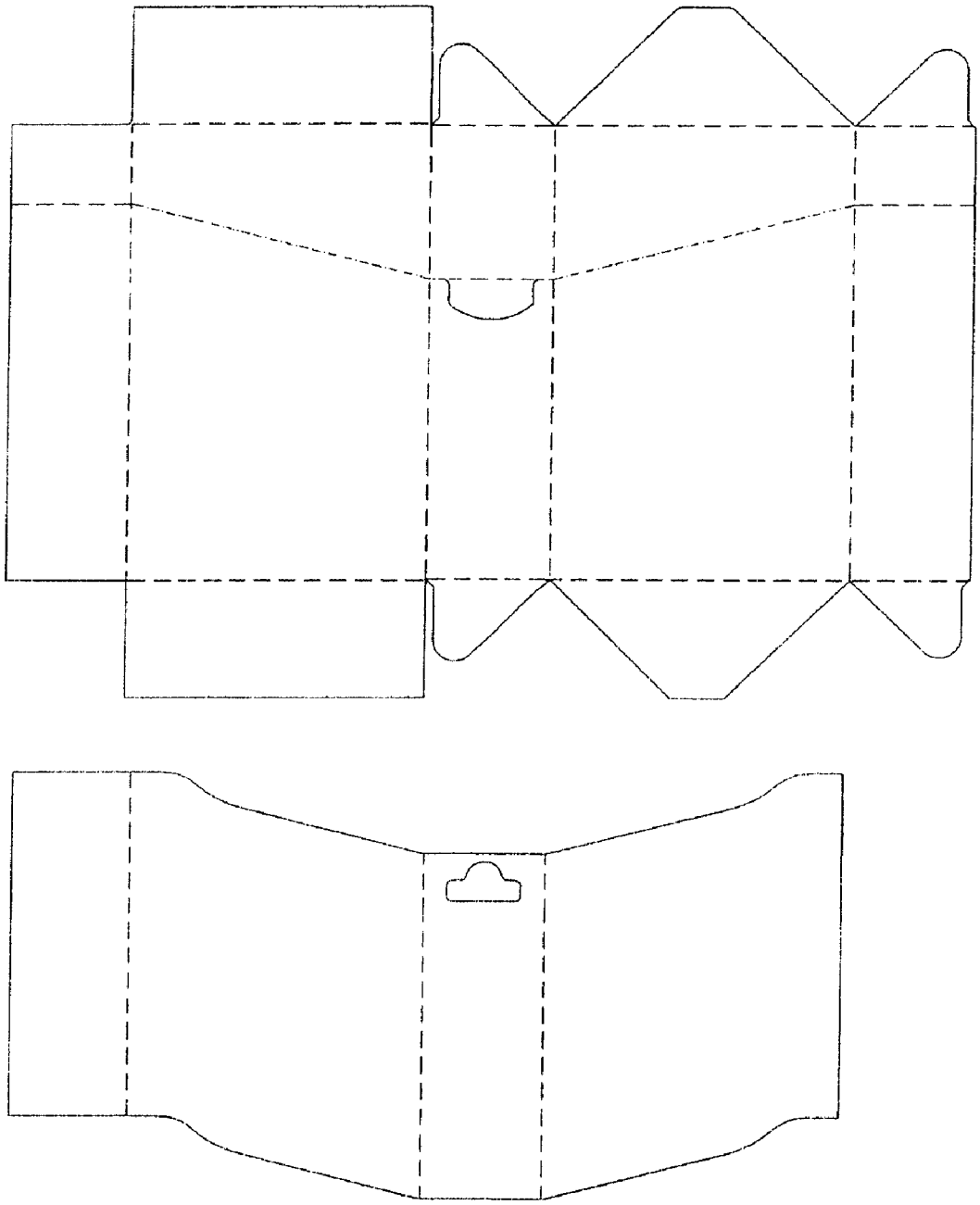
Figure 16:
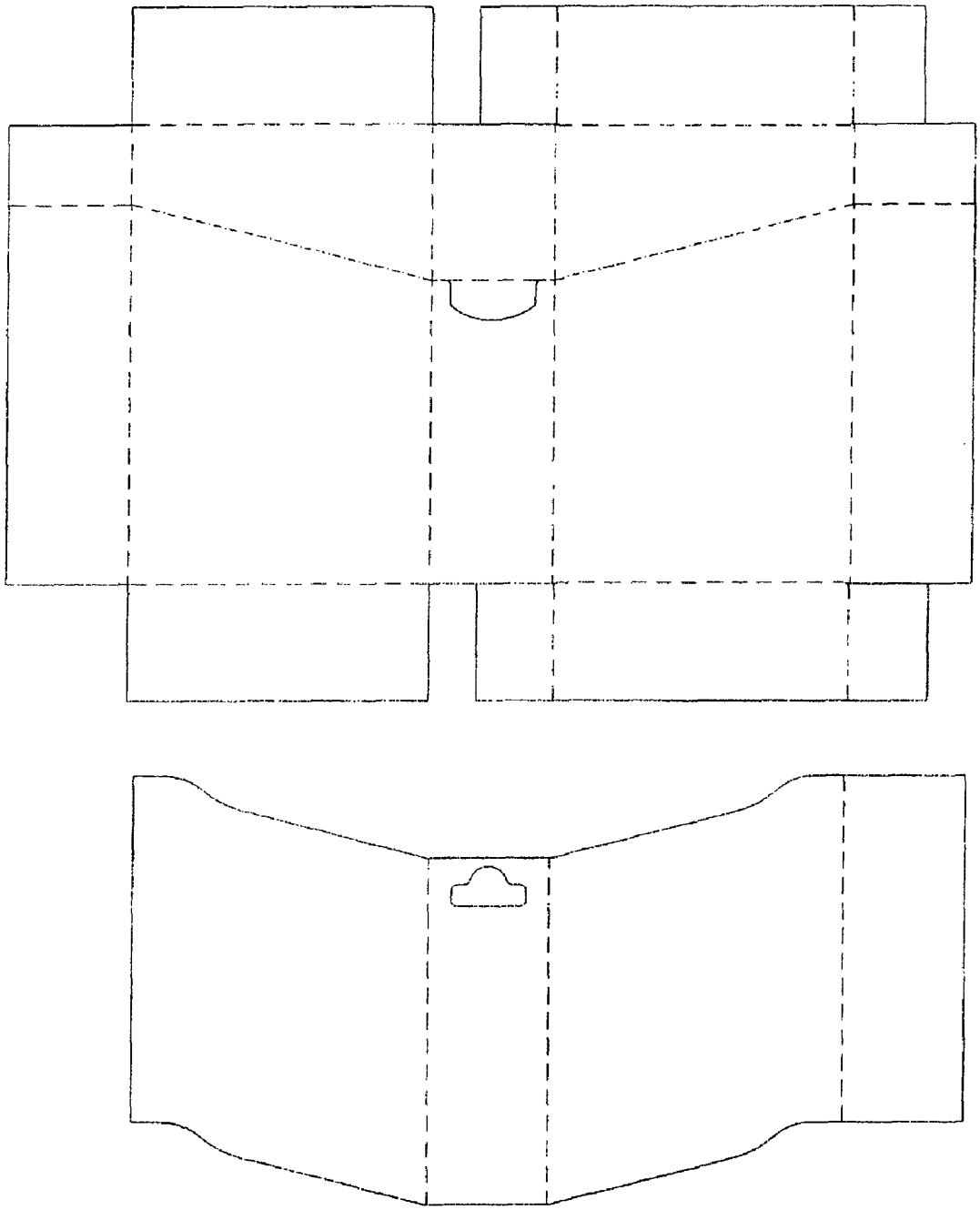
Figure 17:
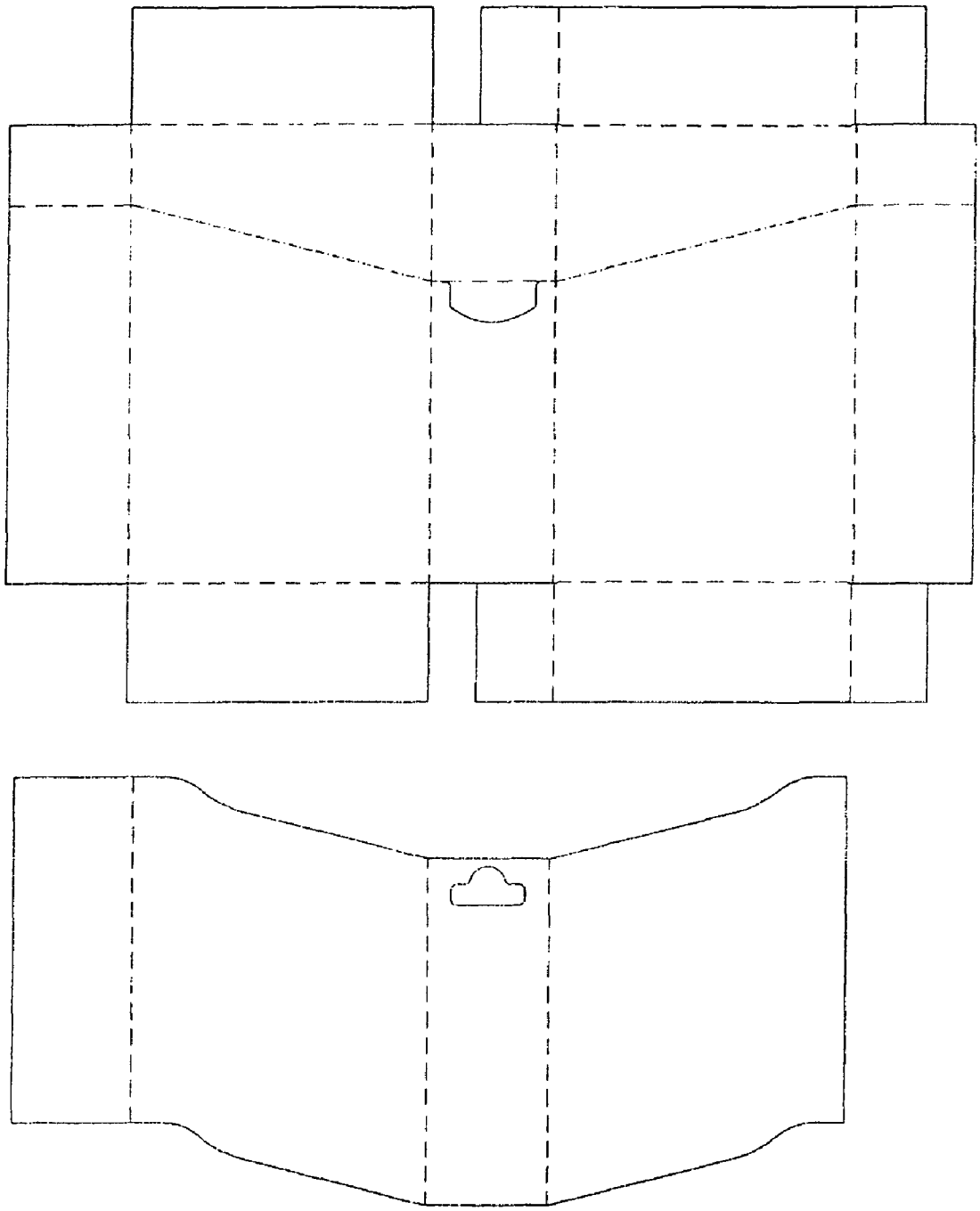
Figure 18:
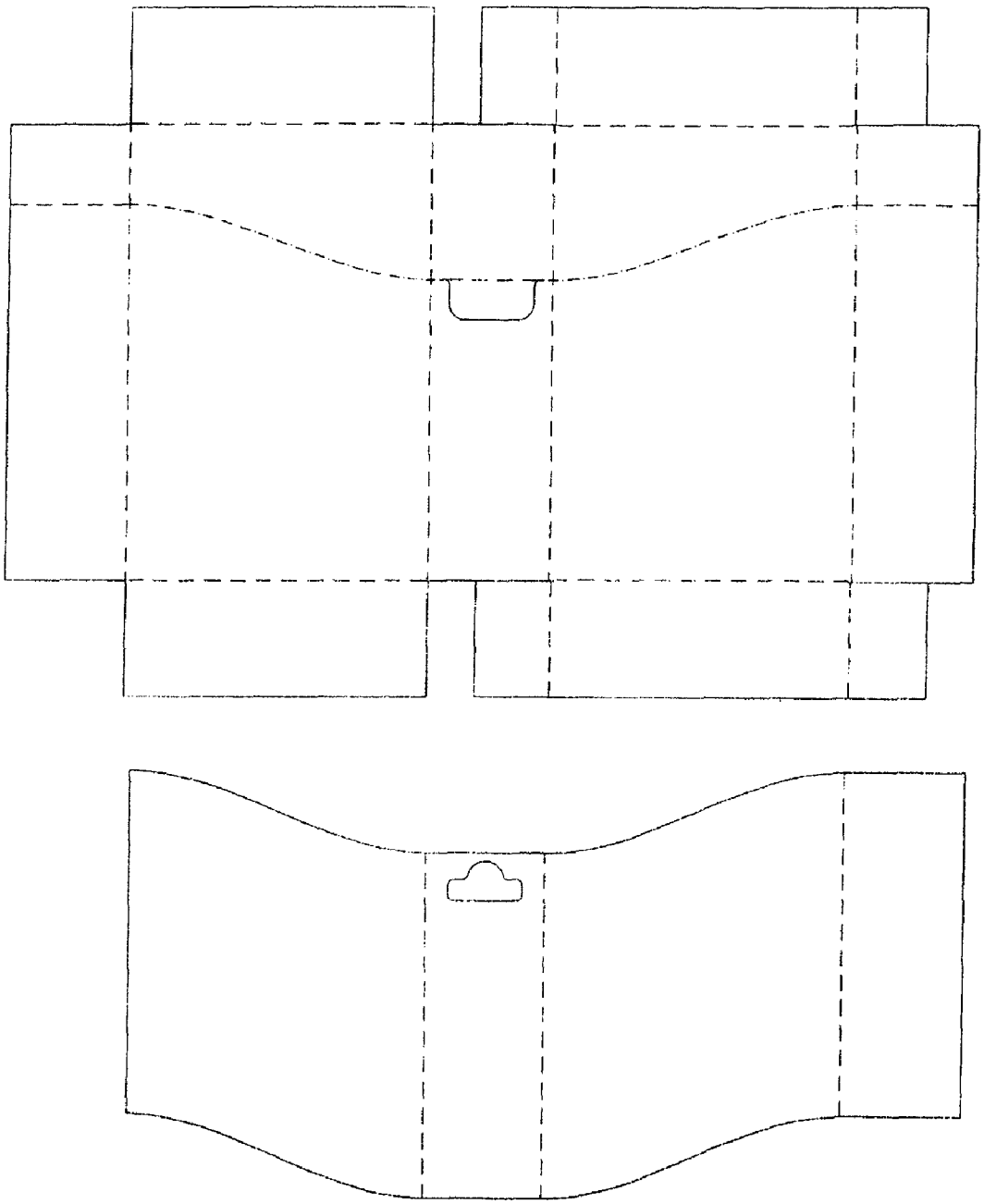
Figure 19:
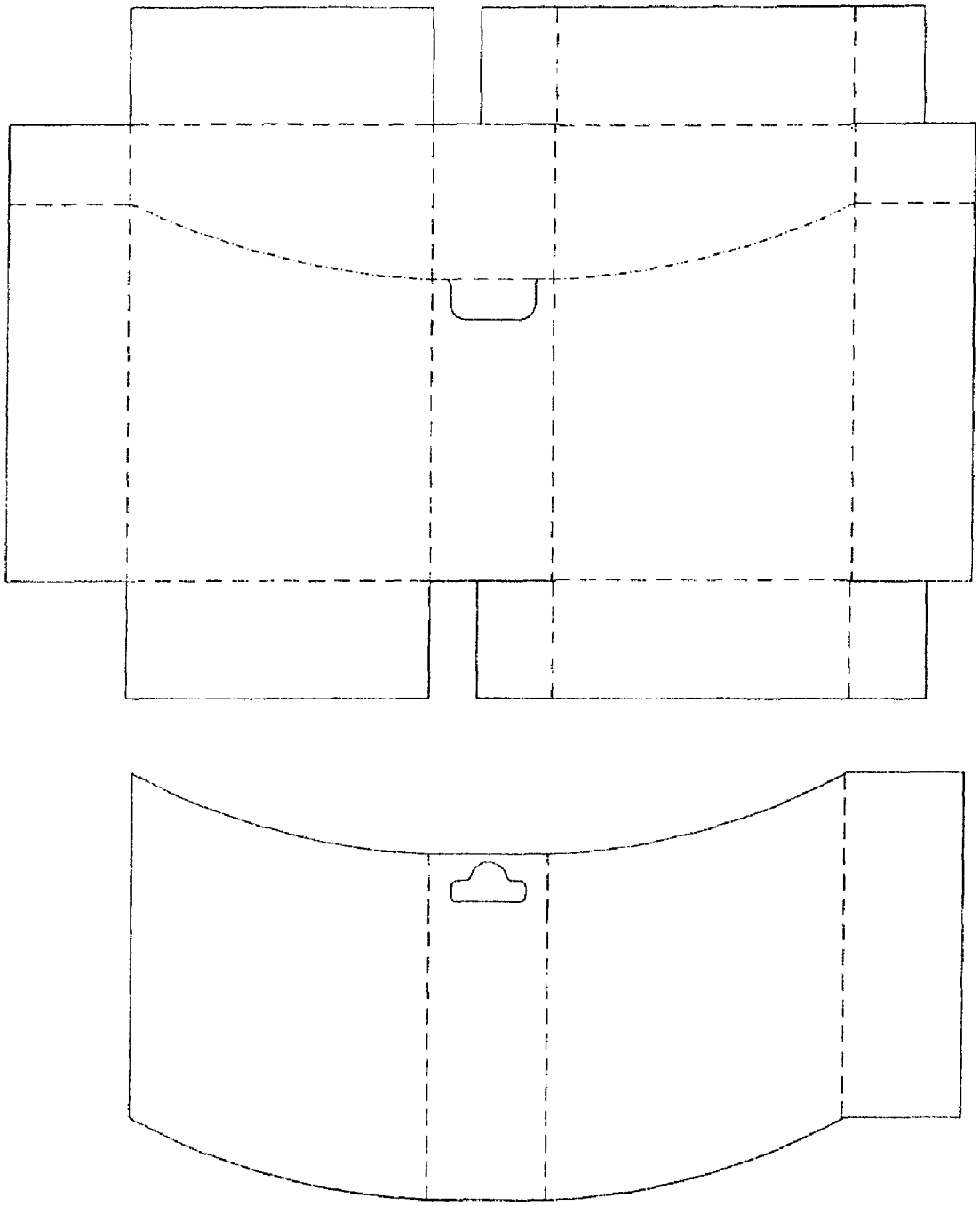
Figure 20:
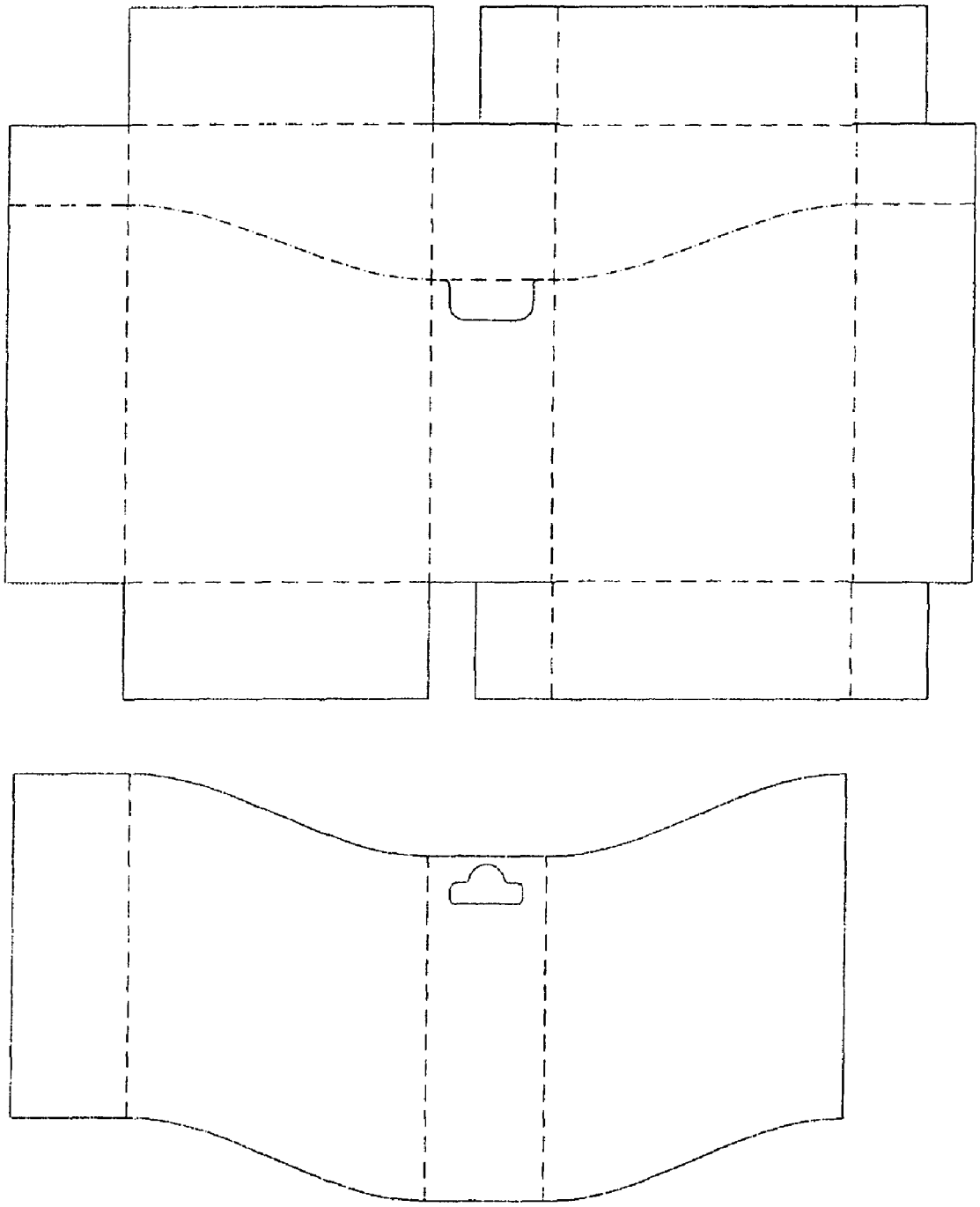
Figure 21:
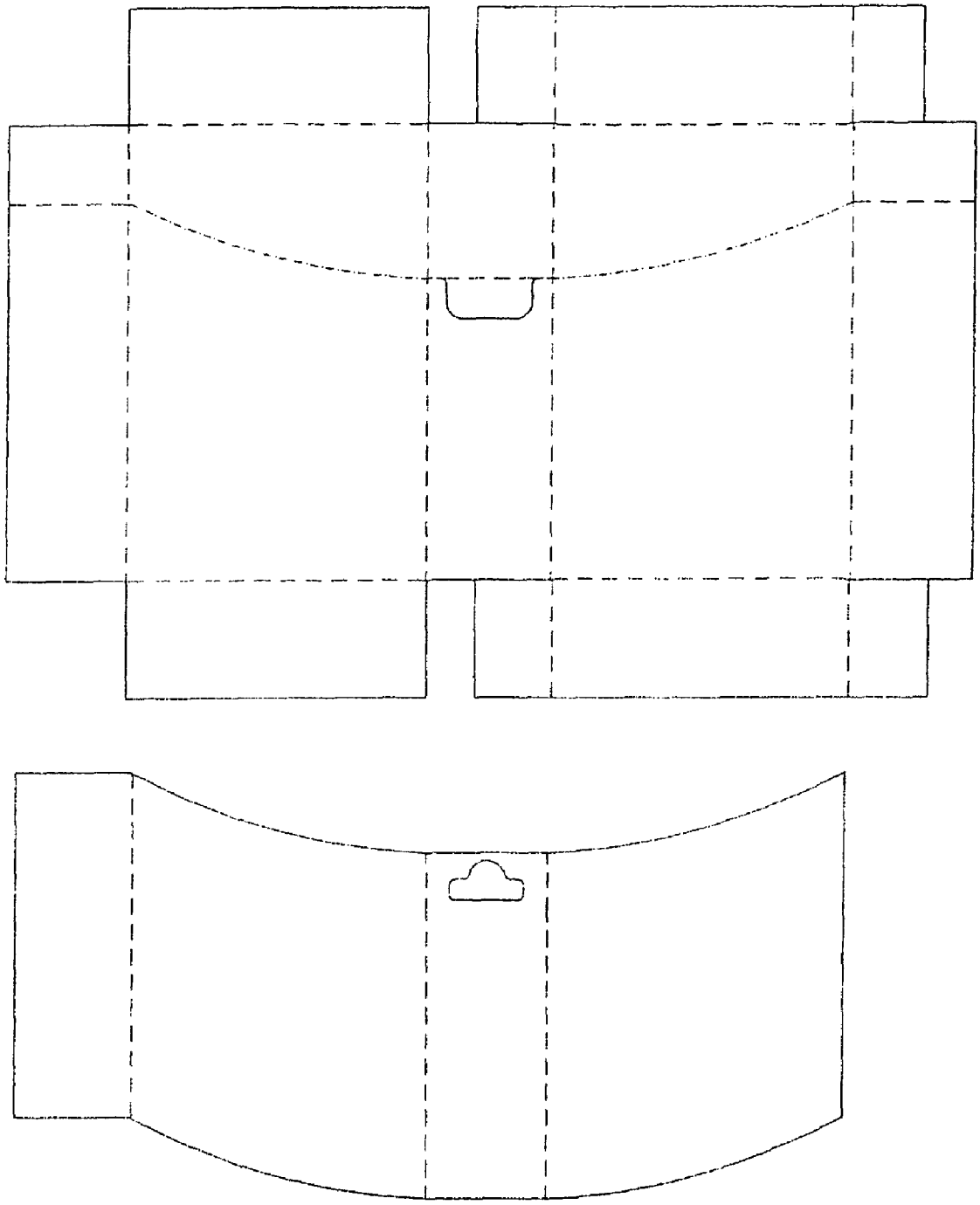
Figure 22:
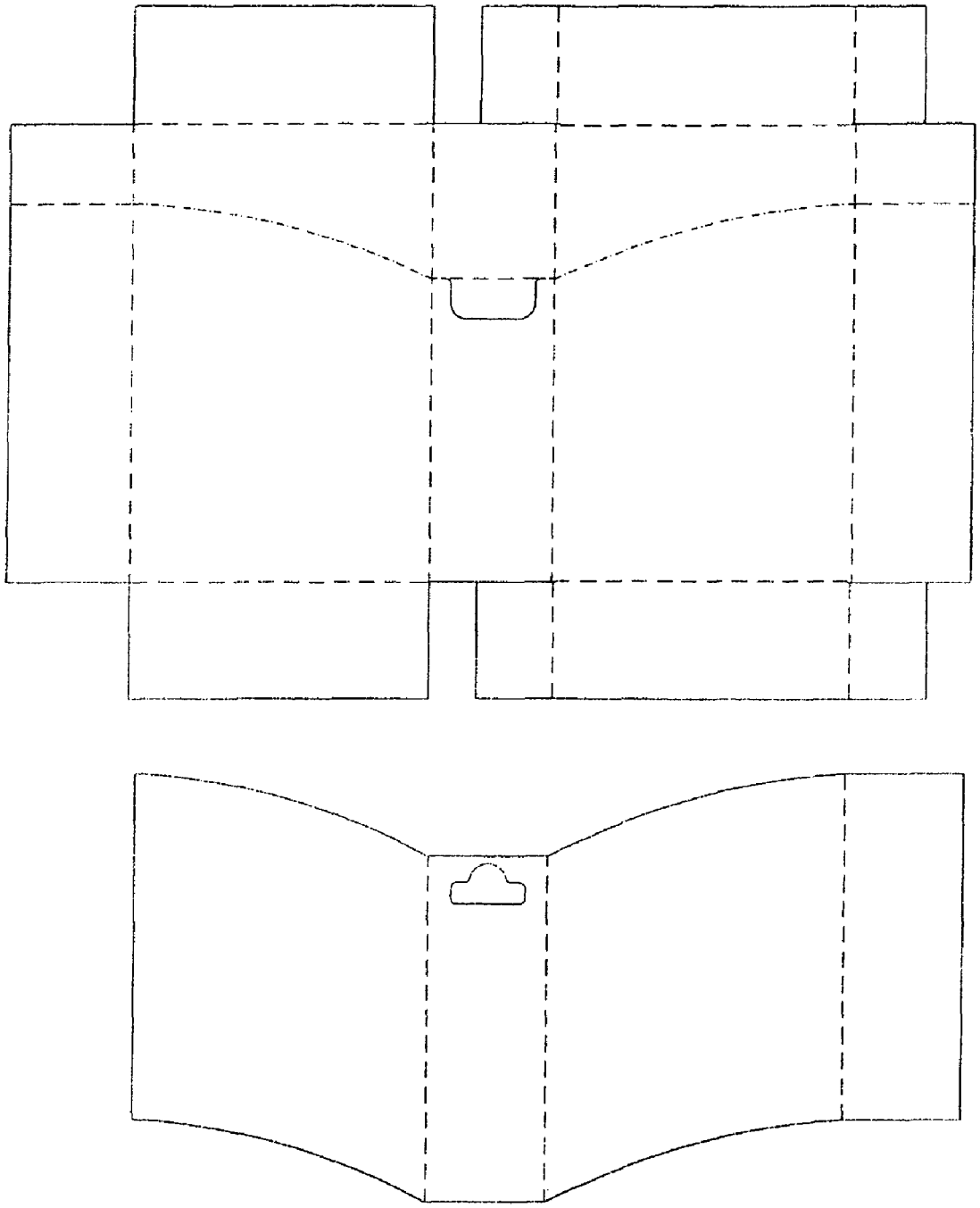
Figure 23:
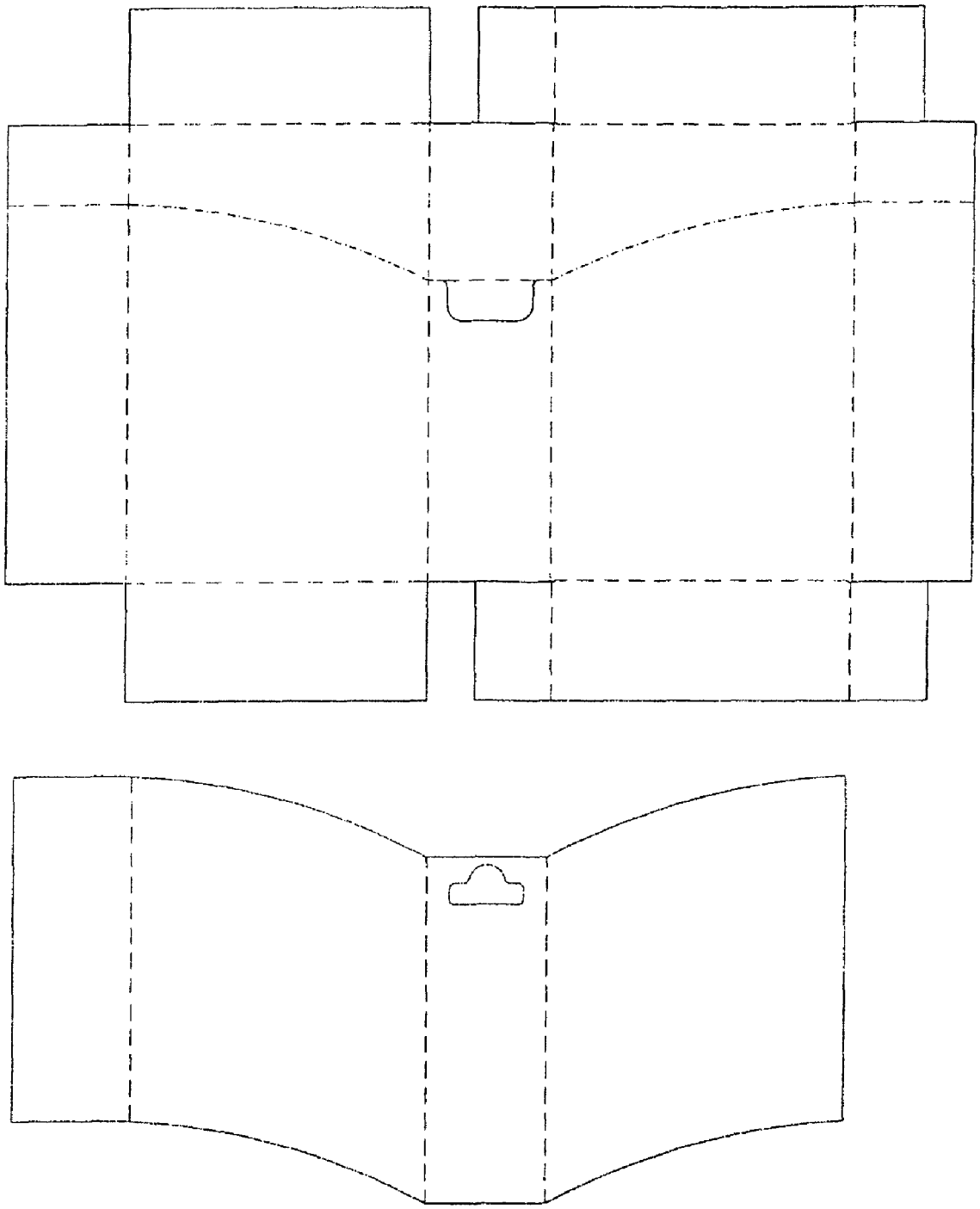

FIG. 6 shows a spread-out collar 16, in which the parts of spread-out collar 16 are indicated, where possible, using the same reference numbers, with superscripts, as for the corresponding parts of the folded collar 16.

More specifically, spread-out collar 16 comprises a number of longitudinal fold lines 26, which define a panel 17' forming minor wall 17; a panel 19' forming major wall 19; a panel 18' forming minor wall 18; and a panel 20' forming major wall 20. Bottom tab 23 is connected to panel 18' along a transverse fold line 25.

Figure 7:
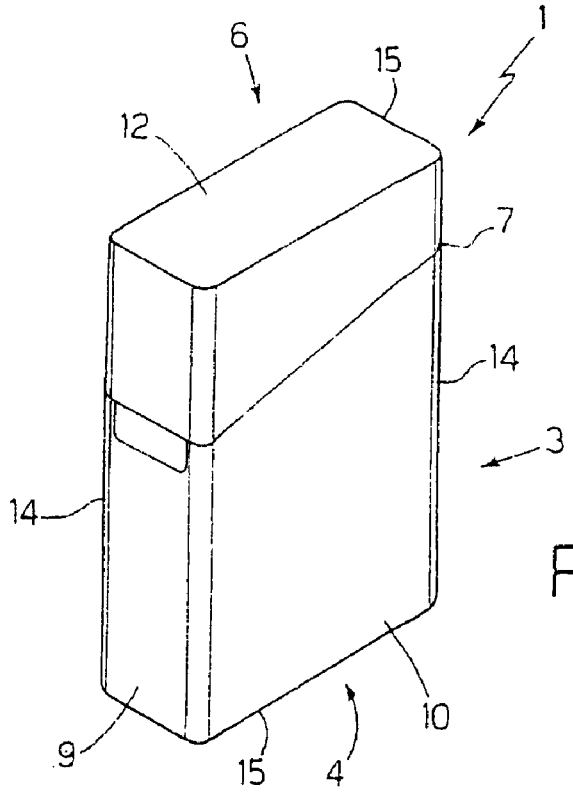
FIG. 7 shows a front view in perspective of a variation of the rigid packet of cigarettes in FIGS. 1-4.

In the FIG. 1-4 embodiment, longitudinal edges 14 and transverse edges 15 are all square. In the FIG. 7 variation, longitudinal edges 14 are rounded; in which case, to form rounded edges 14, blank 24 must comprise four groups of closely spaced longitudinal fold lines to allow blank 24 to flex locally into a circular shape. In different embodiments not shown, at least some of longitudinal edges 14 are rounded or bevelled, or at least some of transverse edges 15 are rounded or bevelled (as in the packet of cigarettes described in Patent Application EP0764595A1). Alternatively, some longitudinal edges 14 and some transverse edges 15 may be non-square, rounded or bevelled edges, so as to have both non-square, rounded or bevelled longitudinal edges 14 and transverse edges 15.

In a different embodiment not shown, packet 1 of cigarettes may resemble the packet of cigarettes described in Patent Application EP1066206A1; in which case, major lateral walls 10 and 11 are outwardly convex, and each have a flat central portion, and two curved creased lateral bands connecting the flat central portion to minor lateral walls 8 and 9 at respective sharp, non-square longitudinal edges 14. Changes may obviously be made to packets 1 of cigarettes resembling the packet of cigarettes described in Patent Application EP1066206A1, such as partly curving the convex walls, or only curving one wall as opposed to two opposite walls, or curving minor lateral walls 8 and 9 as opposed to major lateral walls 10 and 11. By way of example, a few variations of the packet of cigarettes described in Patent Application EP1066206A1 are proposed in Patent Application WO03026984A1.

FIGS. 8-15 show variations of blank 24 and/or collar 16 as described above and for producing a packet 1 of cigarettes of the type shown in FIG. 1 (i.e. with hinge 7 on minor lateral wall 8). More specifically, the FIG. 8-15 embodiments propose different embodiments of tabs 27, 28 and tear line 29.

FIGS. 16-26 show variations of blank 24 and/or collar 16 as described above. More specifically, in the FIG. 16-26 embodiments, minor tabs 28, as opposed to being connected to panels 9', 8" along transverse fold lines 25, are connected to major tabs 27 along longitudinal fold lines 26, and different embodiments of tabs 27, 28 and tear line 29 are proposed.

Figure 27:
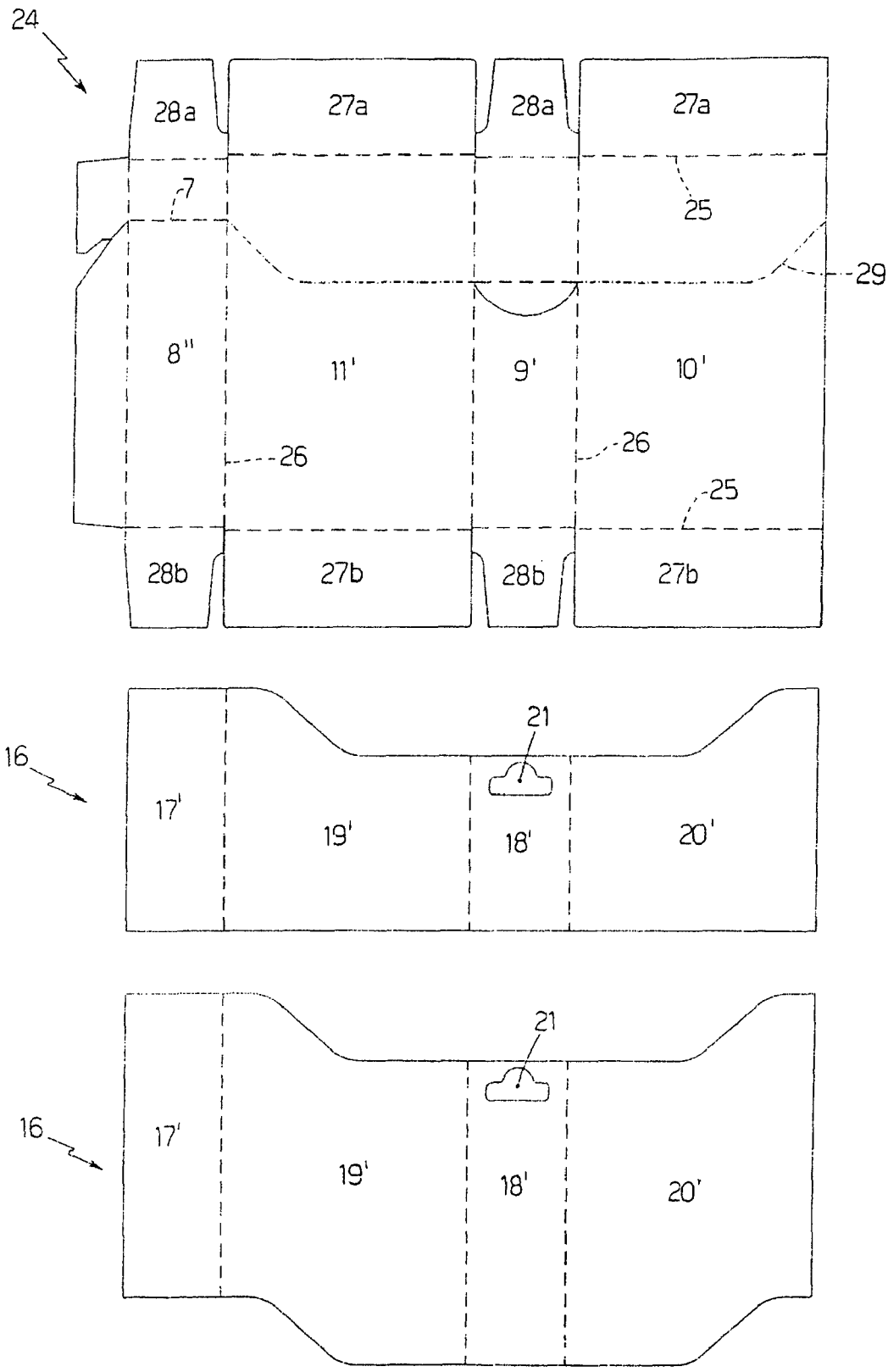

FIG. 27 shows a variation of blank 24 having no panel 8'.

Figure 28:
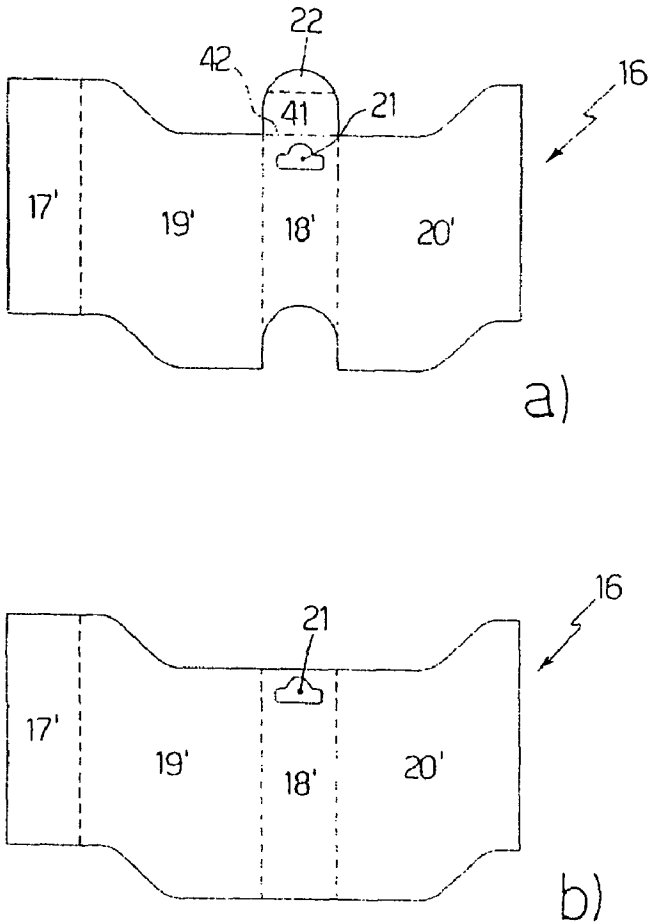

FIG. 28 shows four variations of collar 16, which differ from the FIG. 6 collar 16 as regards the shape of the top edge and, hence, also the bottom edge, which must match the top edge.

Figure 29:
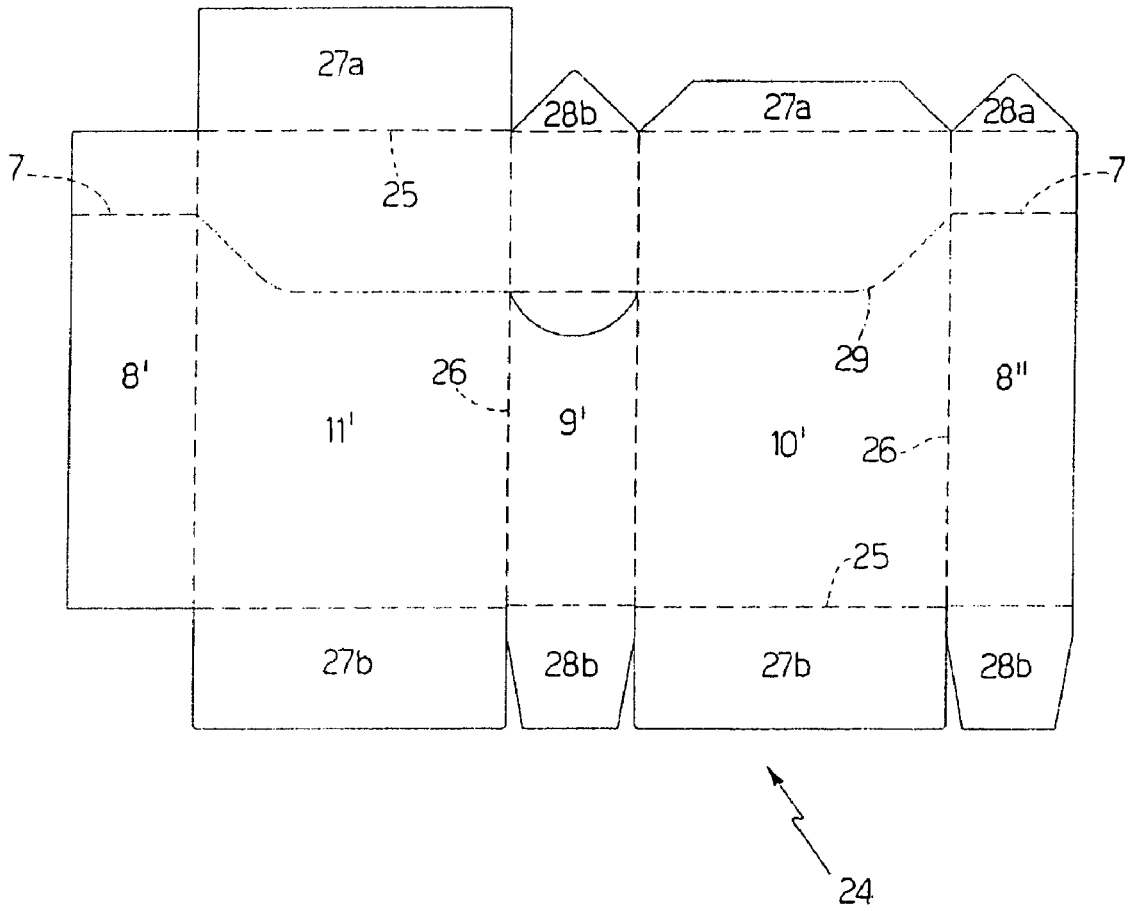
Figure 30:
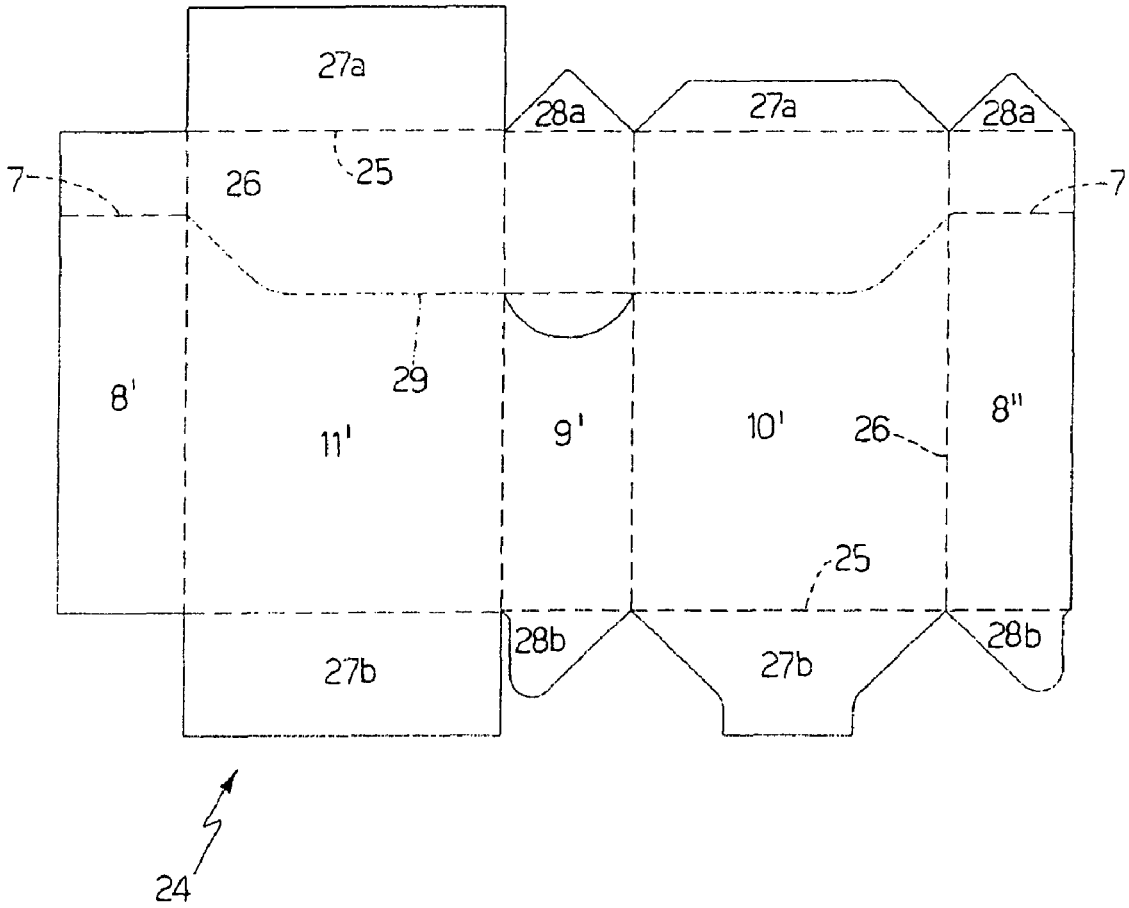

FIGS. 29 and 30 show two variations of blank 24, in which a first major tab 27*a*, connected to panel 11' (and forming part of top wall 12), is the same shape and size as top wall 12; and a second major tab 27*a*, connected to panel 10' (and forming part of top wall 12), and minor tabs 28*a* (forming part of top wall 12) are less than half the height of first major tab 27*a*.

In a preferred embodiment, first major tab 27*a* is rectangular; second major tab 27*a* is in the form of an isosceles trapezium with the major base coincident with a transverse fold line 25; and each minor tab 28*a* is in the form of an isosceles triangle, and shaped so as not to overlap second major tab 27*a* when folding blank 24.

A third major tab 27*b* (forming part of bottom wall 13) is the same shape and size as bottom wall 13; and a fourth major tab 27*b* (forming part of bottom wall 13) is the same height as third major tab 27*b*.

In the FIG. 30 embodiment, third major tab 27*b* is rectangular; fourth major tab 27*b* is of composite shape comprising a base in the form of an isosceles trapezium with the major base coincident with a transverse fold line 25, and a rectangular appendix; and each minor tab 28*b* (forming part of bottom wall 13) is substantially triangular, and shaped so as not to overlap fourth major tab 27*b* when folding blank 24.

In the FIG. 29 embodiment, third major tab 27*b* and fourth major tab 27*b* are each substantially in the form of an isosceles trapezium with the major base coincident with a transverse fold line 25, and the minor tabs 28*b* (forming part of bottom wall 13) are each in the form of an isosceles trapezium with the major base coincident with a transverse fold line 25.

Blank 24 in FIG. 29 or 30 is particularly suitable for folding about a group 2 of cigarettes together with an inner sheet of foil packing material. In which case, the inner sheet of packing material is folded into a tube about group 2 of cigarettes, leaving two open ends 30 and 31 (FIGS. 31 and 34); blank 24 is then folded into a tube about group 2 of cigarettes and on top of the previously folded inner sheet of packing material; open end 30 of the inner sheet of packing material is then folded together with major tabs 27*a* and minor tabs 28*a* forming part of top wall 12; and, finally, open end 31 of the inner sheet of packing material is folded together with major tabs 27*b* and minor tabs 28*b* forming part of bottom wall 13.

Figure 31:
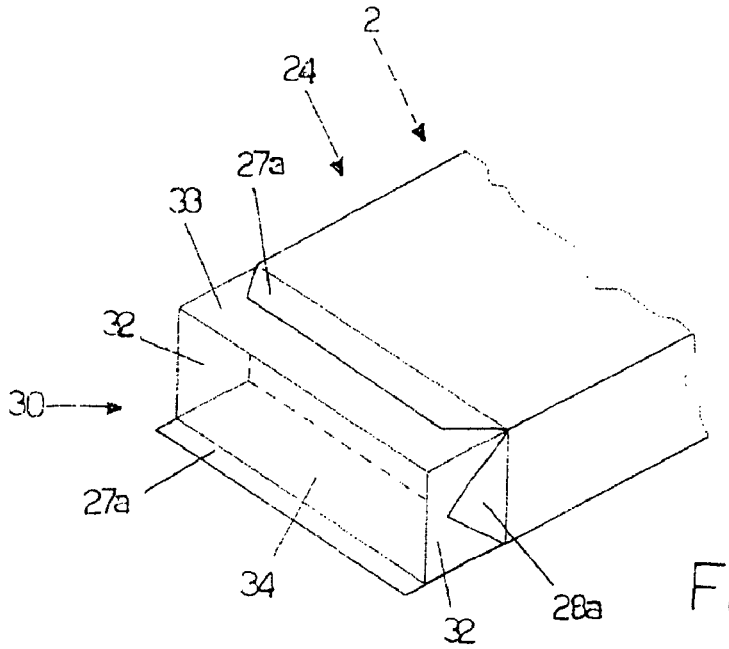
FIGS. 31-36 show steps in the folding of tabs of the FIG. 30 blank to form a rigid packet of cigarettes of the type shown in FIG. 1.
Figure 32:
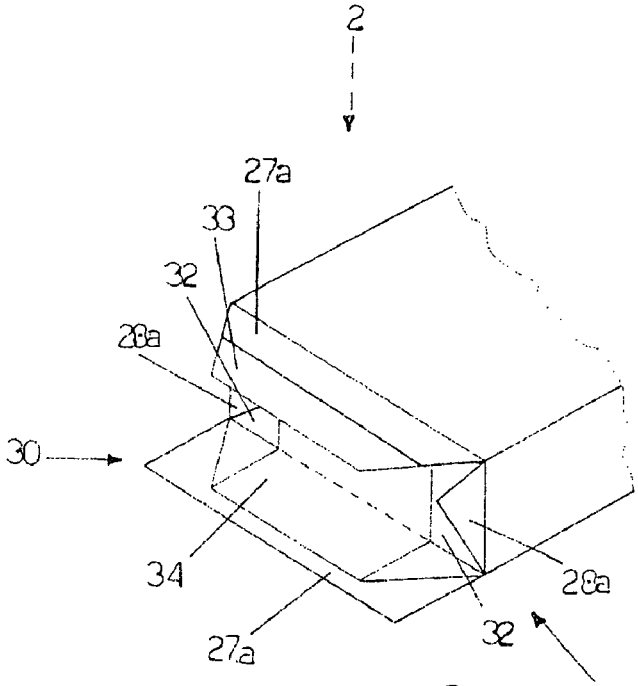
Figure 33:
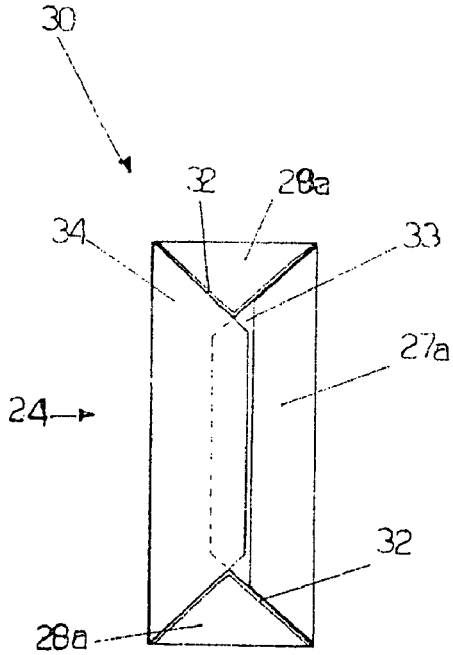

FIGS. 31-33 show folding of open end 30 of the inner sheet of packing material together with major tabs 27*a* and minor tabs 28*a* of the blank 24 shown in FIG. 30. To begin with (FIG. 31), both open end 30 of the inner sheet of packing material, and major tabs 27*a* and minor tabs 28*a* of blank 24 are in an unfolded condition, and the first operation (FIG. 32) is to fold minor tabs 28*a* and corresponding portions 32 of the inner sheet of packing material together onto group 2 of cigarettes; next (FIG. 33), second major tab 27*a* and a corresponding portion 33 of the inner sheet of packing material are folded together onto group 2 of cigarettes; and, finally, first major tab 27*a* and a corresponding portion 34 of the inner sheet of packing material are folded together onto group 2 of cigarettes and on top of the previously folded second major tab 27*a* and minor tabs 28*a*, so that portion 34 of the inner sheet of packing material does not overlap second major tab 27*a* and minor tabs 28*a*.

It is important to note that portion 34 of the inner sheet of packing material does not overlap second major tab 27*a* and minor tabs 28*a*, on account of second major tab 27*a*, connected to panel 10', and minor tabs 28*a* being less than half the height of first major tab 27*a* connected to panel 11'. Obviously, the exact height of second major tab 27*a* and of minor tabs 28*a* depends on the size of portions 33 and 34 of the inner sheet of packing material, and is always such as to prevent overlapping by portion 34 of the inner sheet of packing material. At any rate, an essential requisite to prevent overlapping by portion 34 of the inner sheet of packing material is that second major tab 27*a* and minor tabs 28*a* be less than half the height of first major tab 27*a*.

By preventing portion 34 of the inner sheet of packing material from overlapping second major tab 27*a* and minor tabs 28*a*, lid 6 can be opened without interfering in any way with the inner sheet of packing material. In other words, once folded, open end 30 of the inner sheet of packing material is free of (i.e. in no way "caught" in) outer package 3 (i.e. by major tabs 27*a* and minor tabs 28*a*), so lid 6 can be opened without disturbing the inner sheet of packing material. This is an important characteristic, by enabling the inner sheet of packing material and blank 24 to be folded together, as described above. In fact, without this characteristic, the first time lid 6 is opened, at least portion 34 of the inner sheet of packing material would be lifted with lid 6, thus altering the fold of the inner sheet of packing material and seriously impairing the look of the inside of packet 1 of cigarettes.

Figure 34:
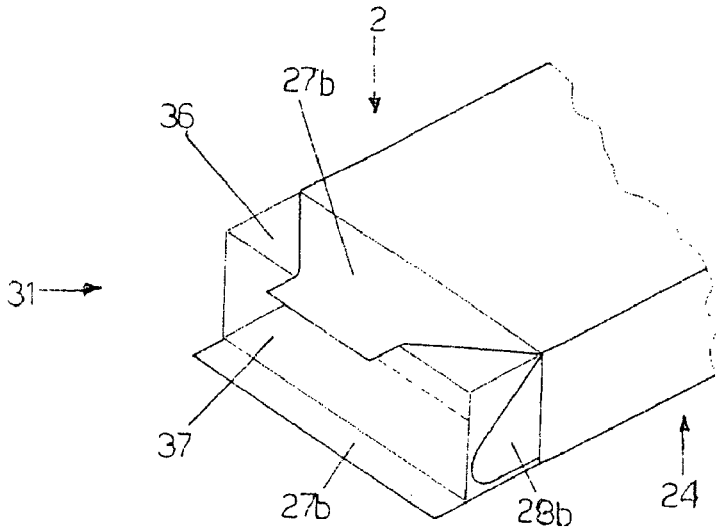
Figure 35:
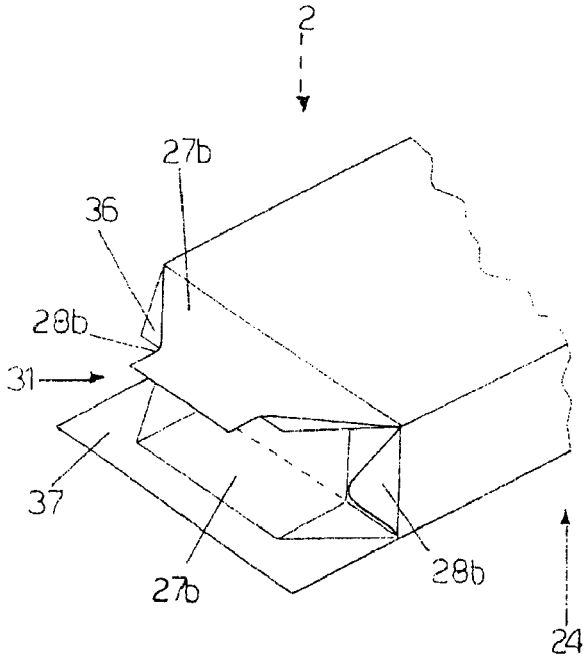
Figure 36:
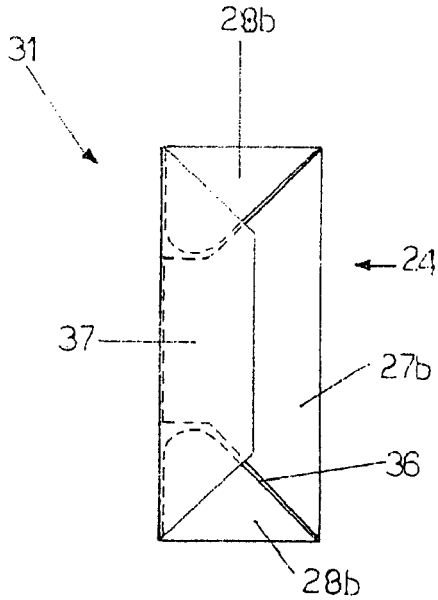

FIGS. 34-36 show folding of open end 31 of the inner sheet of packing material together with major tabs 27*b* and minor tabs 28*b* of the blank 24 shown in FIG. 30. To begin with (FIG. 34), both open end 31 of the inner sheet of packing material, and major tabs 27*b* and minor tabs 28*b* of blank 24 are in an unfolded condition, and the first operation (FIG. 35) is to fold minor tabs 28*b* and corresponding portions 35 of the inner sheet of packing material together onto group 2 of cigarettes; next (FIG. 36), fourth major tab 27*b* and a corresponding portion 36 of the inner sheet of packing material are folded together onto group 2 of cigarettes; and, finally, third major tab 27*b* and a corresponding portion 37 of the inner sheet of packing material are folded together onto group 2 of cigarettes and on top of the previously folded fourth major tab 27*b* and minor tabs 28*b*, so that portion 37 of the inner sheet of packing material overlaps at least fourth major tab 27*b* and minor tabs 28*b*.

It is important to note that portion 37 of the inner sheet of packing material overlaps fourth major tab 27*b* and minor tabs 28*b*, on account of fourth major tab 27*b*, connected to panel 10', and minor tabs 28*b* being at least half the height of third major tab 27*b* connected to panel 11'. Obviously, the exact height of fourth major tab 27*b* and of minor tabs 28*b* depends on the size of portions 36 and 37 of the inner sheet of packing material, and is always such as to achieve significant overlap by portion 37 of the inner sheet of packing material. At any rate, an essential requisite to achieve significant overlap by portion 37 of the inner sheet of packing material is that fourth major tab 27*b* and minor tabs 28*b* be at least half the height of third major tab 27*b* and preferably the same height as third major tab 27*b*.

Overlapping portion 37 of the inner sheet of packing material on fourth major tab 27*b* and minor tabs 28*b* improves the overall stability of packet 1 of cigarettes, by fixing the bottom end of group 2 of cigarettes, wrapped in the inner sheet of packing material, to the bottom end of outer package 3.

FIGS. 37-55 show different types of blanks 24, each for forming a packet 1 of cigarettes as shown in FIG. 1 (i.e. with hinge 7 on minor lateral wall 8), and each incorporating a respective collar 16. More specifically, and with reference to FIG. 37, each blank 24 comprises a main body 38 for forming outer package 3; and an end appendix 39 for forming collar 16, and which is connected to main body 38 by at least one connecting panel 40.

The blanks 24 shown in FIGS. 37-49 each comprise a main body 38 for forming outer package 3, and of substantially the same design as blanks 24 in FIGS. 5 and 8-30; and an end appendix 39 for forming collar 16, and which is located beneath main body 38 and connected to main body 38 by two connecting panels 40.

Figure 37:
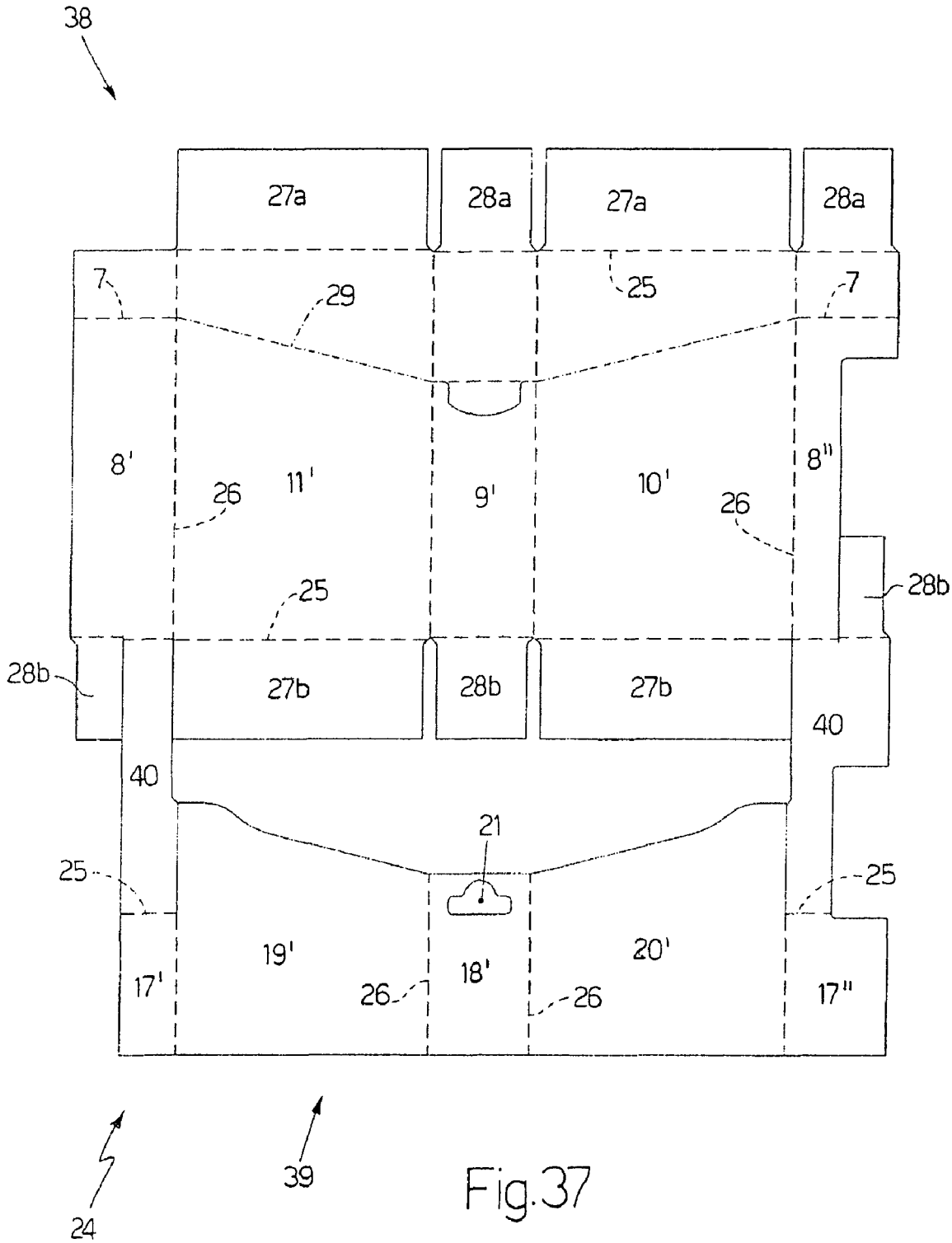
FIGS. 37-56 show plan views of blanks, each incorporating a respective collar.
Figure 38:
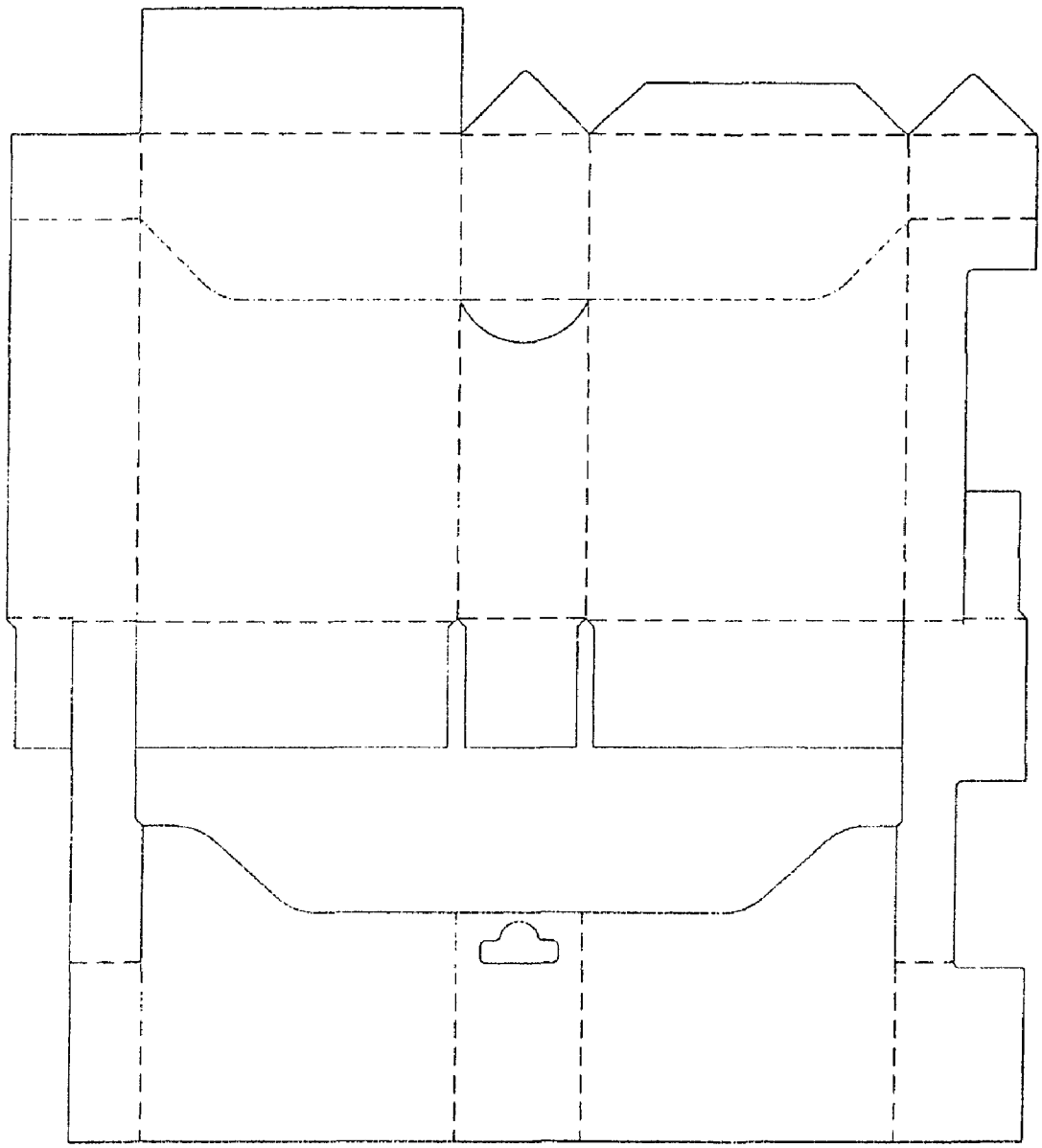

With reference to FIG. 37, main body 38 of blank 24 comprises two transverse fold lines 25, and a number of longitudinal fold lines 26 defining, between the two transverse fold lines 25, a panel 8' defining an inner portion of minor lateral wall 8 of outer package 3; a panel 11' defining major lateral wall 11 of outer package 3; a panel 9' defining minor lateral wall 9 of outer package 3; a panel 10' defining major lateral wall 10 of outer package 3; and a panel 8" defining an outer portion of minor lateral wall 8 of outer package 3.

Panels 10' and 11' each comprise two major tabs 27, which are located at opposite ends of panel 10', 11', are separated from panel 10', 11' by the two transverse fold lines 25, and form part of top wall 12 and bottom wall 13 respectively. More specifically, of each panel 10', 11', a major tab 27*a* forms part of top wall 12, and a major tab 27*b* forms part of bottom wall 13.

Panel 9' comprises two minor tabs 28, which are located at opposite ends of panel 9', are separated from panel 9' by the two transverse fold lines 25, and form part of top wall 12 and bottom wall 13 respectively. More specifically, of panel 9', a minor tab 28*a* forms part of top wall 12, and a minor tab 28*b* forms part of bottom wall 13.

Panel 8" comprises a minor tab 28*a* separated from panel 8" by a transverse fold line 25, and which forms part of top wall 12.

With reference to FIG. 37, end appendix 39 of blank 24 comprises a number of longitudinal fold lines 26, which define a panel 17' forming part of minor lateral wall 17 of collar 16; a panel 19' forming major wall 19 of collar 16; a panel 18' forming minor wall 18 of collar 16; a panel 20' forming major wall 20 of collar 16; and a further panel 17" forming the rest of minor lateral wall 17 of collar 16 when superimposed on and glued to panel 17'.

End appendix 39 of blank 24 is positioned with respect to main body 38 of blank 24 so that: panels 19' and 20' forming major lateral walls 19 and 20 of collar 16 are aligned longitudinally (i.e. in a direction parallel to longitudinal fold lines 26) with panels 10' and 11' forming the corresponding major lateral walls 10 and 11 of outer package 3; panels 17' and 17" together forming minor lateral wall 17 of collar 16 are aligned longitudinally with panels 8' and 8" together forming the corresponding minor lateral wall 8 of outer package 3; and panel 18' forming lateral wall 18 of collar 16 is aligned longitudinally with panel 9' forming the corresponding minor lateral wall 9 of outer package 3.

Each connecting panel 40 extends longitudinally (i.e. in a direction parallel to longitudinal fold lines 26), is hinged at one end to panel 17', 17" along a transverse fold line 25, and is hinged at the opposite end to panel 8', 8" along a further transverse fold line 25. When folding blank 24, the two connecting panels 40 are rotated 180° about the two respective transverse fold lines 25 and with respect to both panels 17', 17" and panels 8', 8", so that one face of both connecting panels 40 contacts panels 17' and 17", and the other face contacts panels 8' and 8". It is important to note that blank 24 has a printed face and a nonprinted face, and connecting panels 40 are folded as described above so that the printed face of collar 16 contacts the nonprinted face of outer package 3 and so faces outwards of the assembled packet 1 of cigarettes.

In the FIG. 37 embodiment, panel 8' is the same width (i.e. measured parallel to transverse fold lines 25) as minor lateral wall 8 of outer package 3. At panel 8', connecting panel 40 is narrower than panel 8', and panel 8' has a minor tab 28*b* located alongside connecting panel 40 and hinged to panel 8' along a transverse fold line 25. In a preferred embodiment, connecting panel 40 is half as wide as panel 8'.

In the FIG. 37 embodiment, at panel 8", connecting panel 40 is the same width (i.e. measured parallel to transverse fold lines 25) as minor lateral wall 8 of outer package 3. Panel 8" is narrower than the corresponding connecting panel 40, and connecting panel 40 has a minor tab 28*b* located alongside panel 8" and hinged to connecting panel 40 along a transverse fold line 25. It is important to note that, once the two connecting panels 40 are rotated as described above, the minor tab 28*b* connected to connecting panel 40 assumes the same position as the minor tab 28*b* connected to panel 8'. In a preferred embodiment, panel 8" is half as wide as connecting panel 40.

Figure 39:
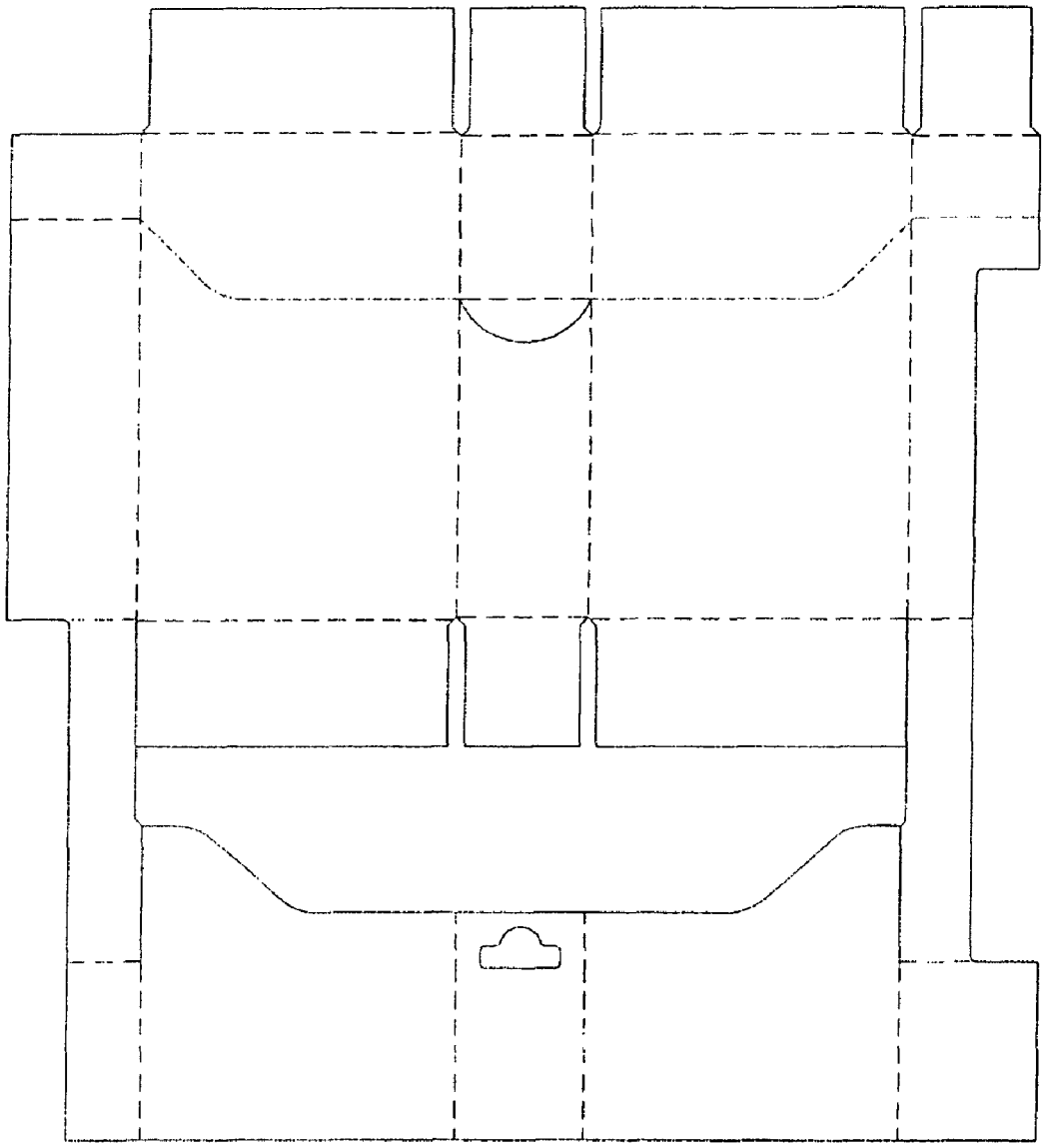
Figure 40:
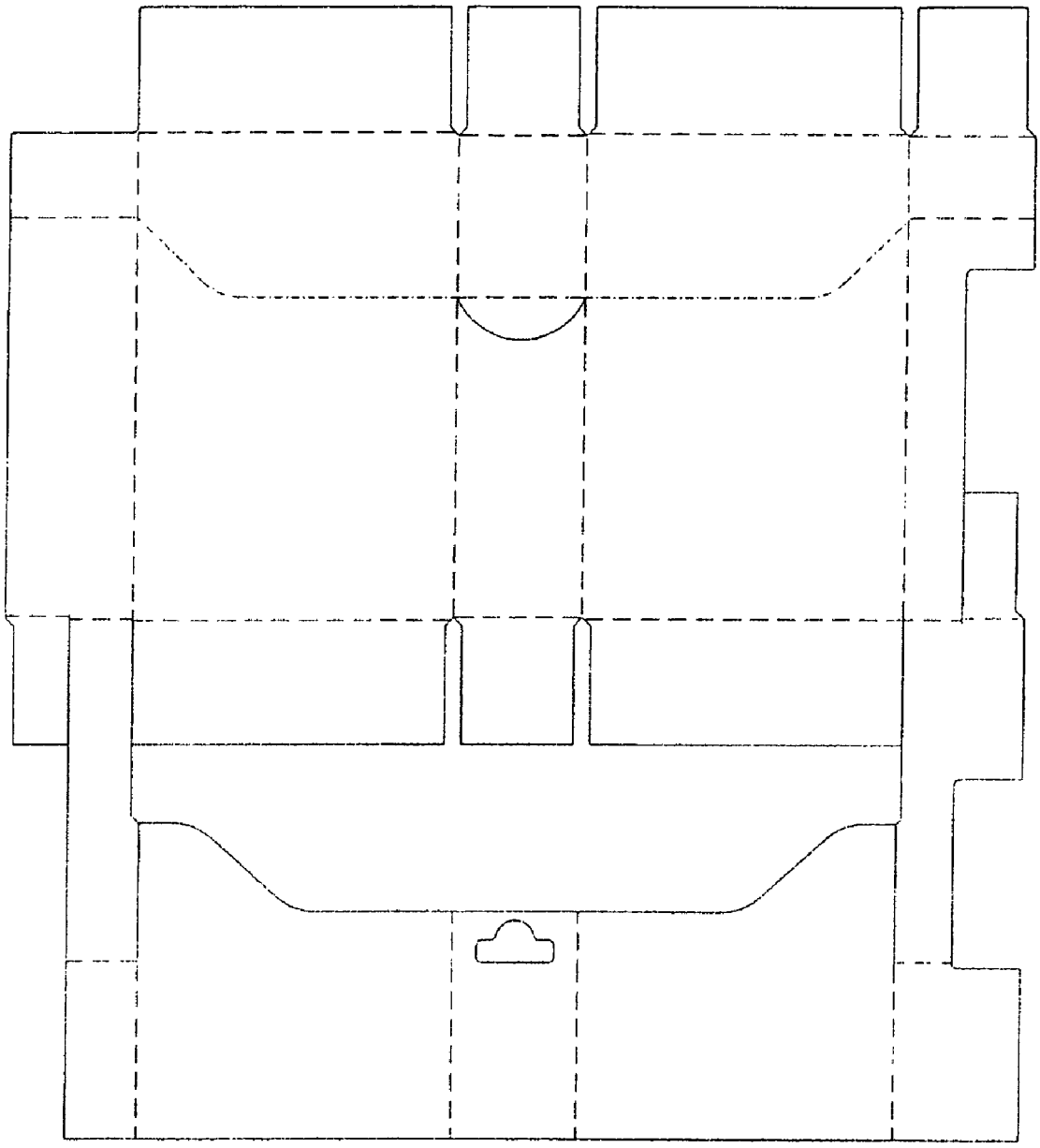
Figure 41:
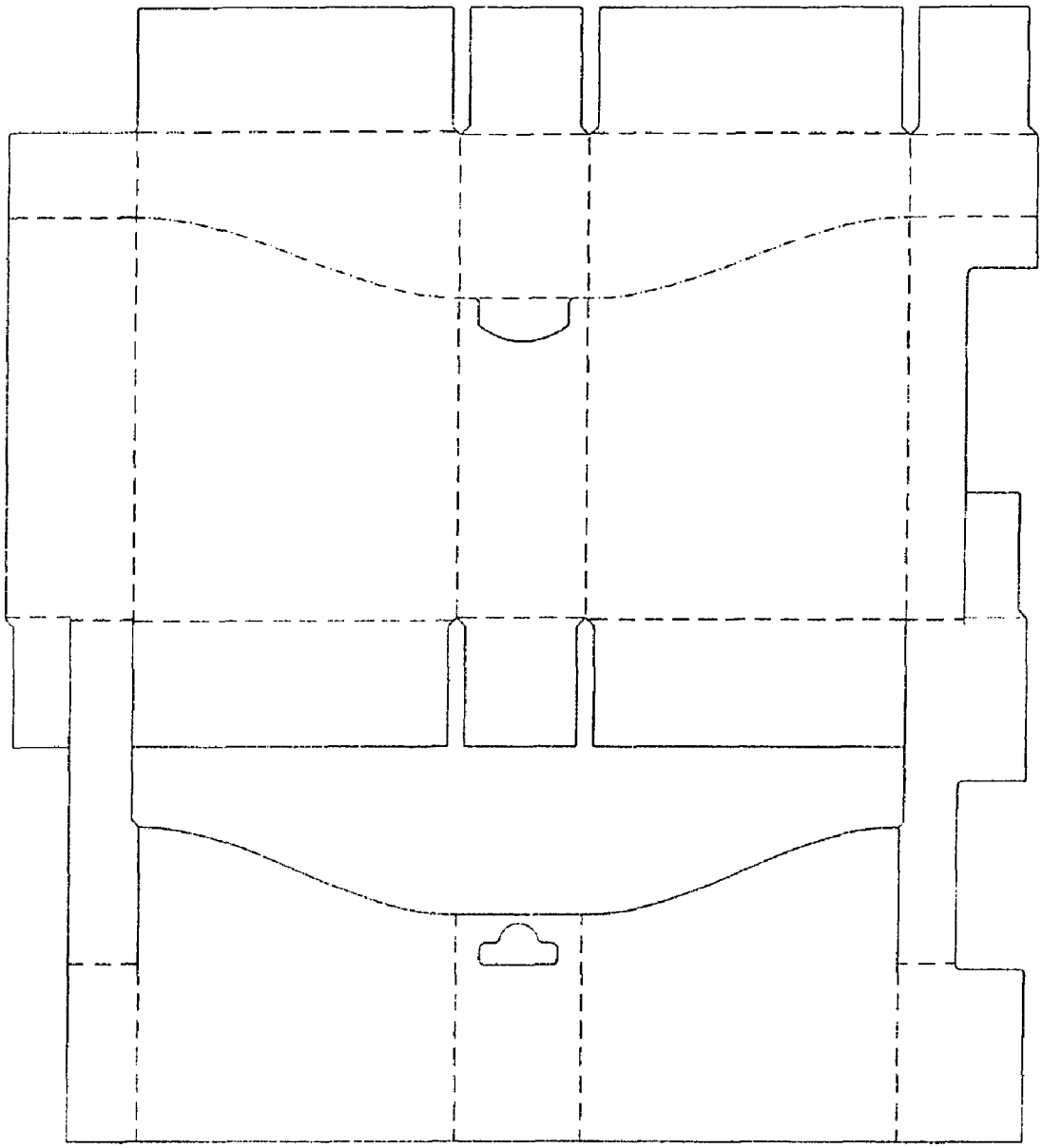
Figure 42:
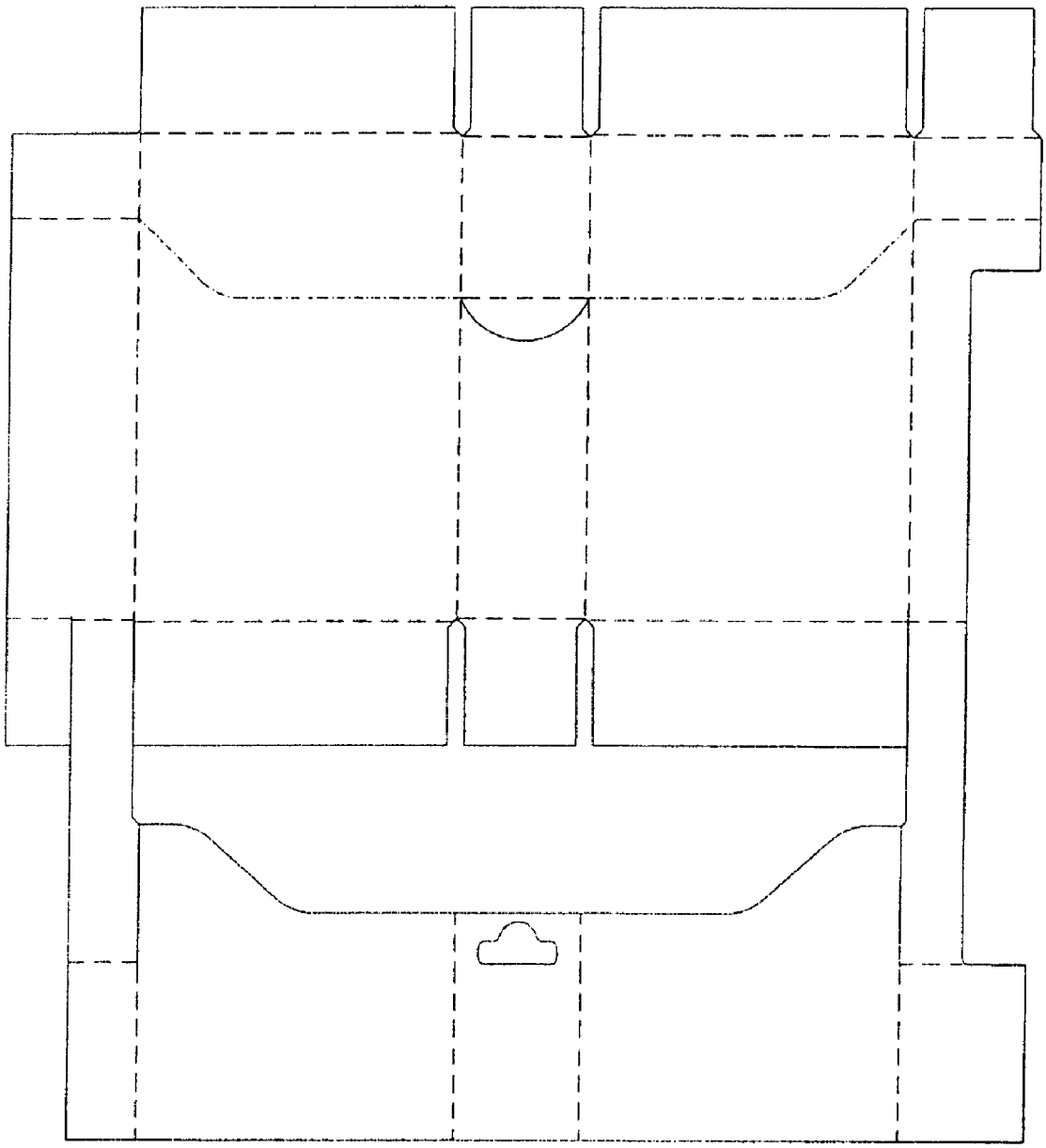
Figure 43:
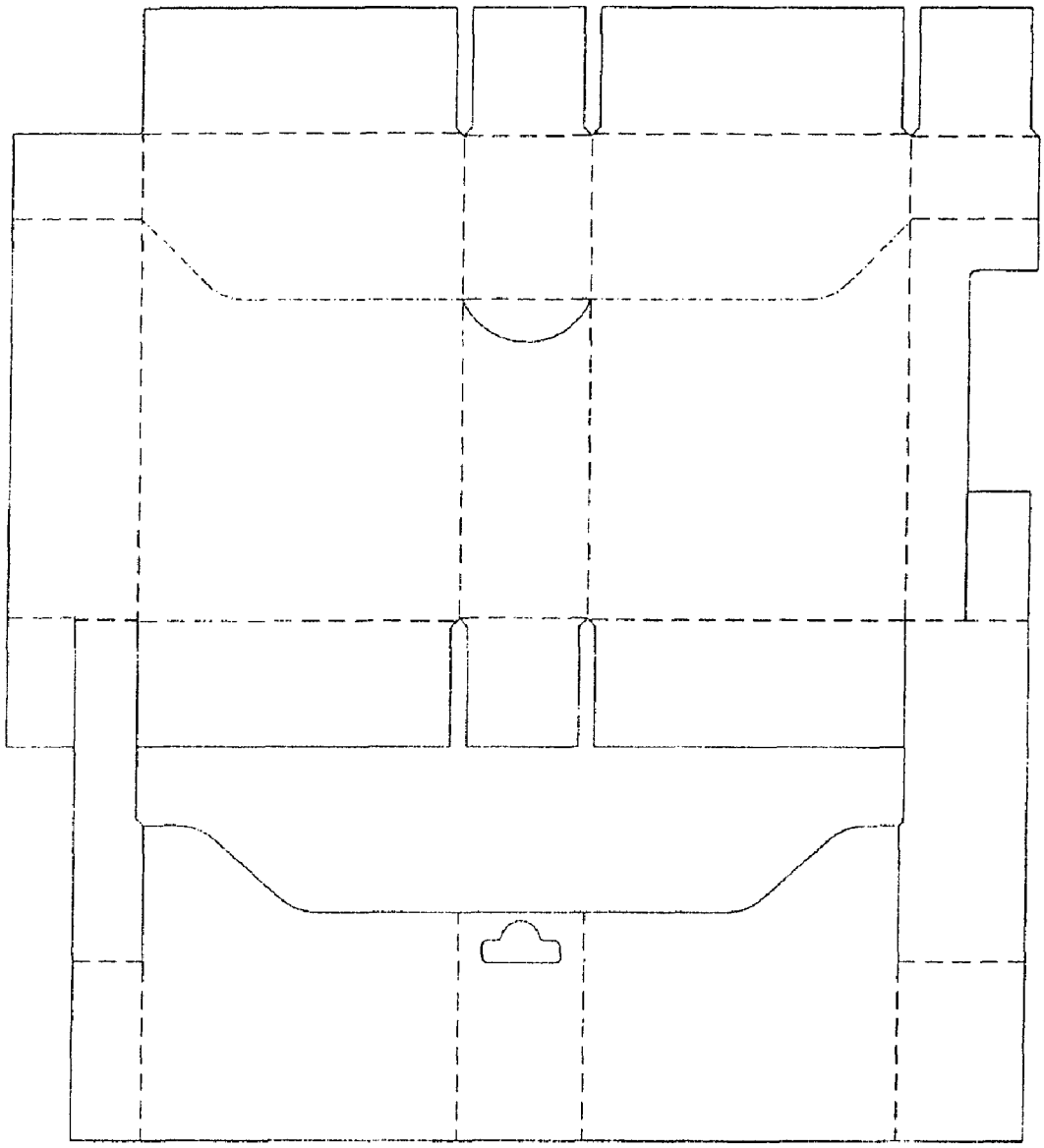
Figure 44:
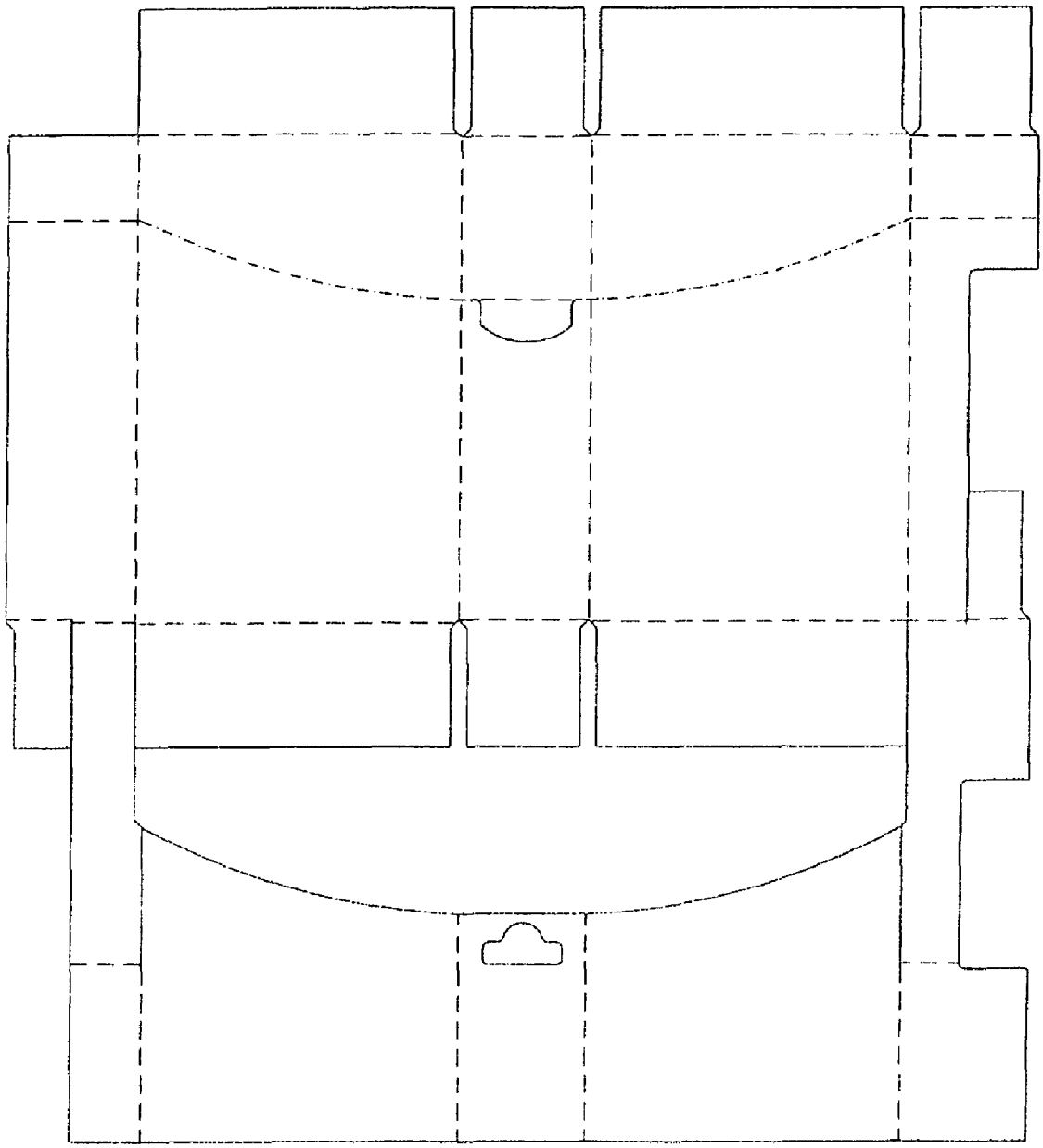
Figure 45:
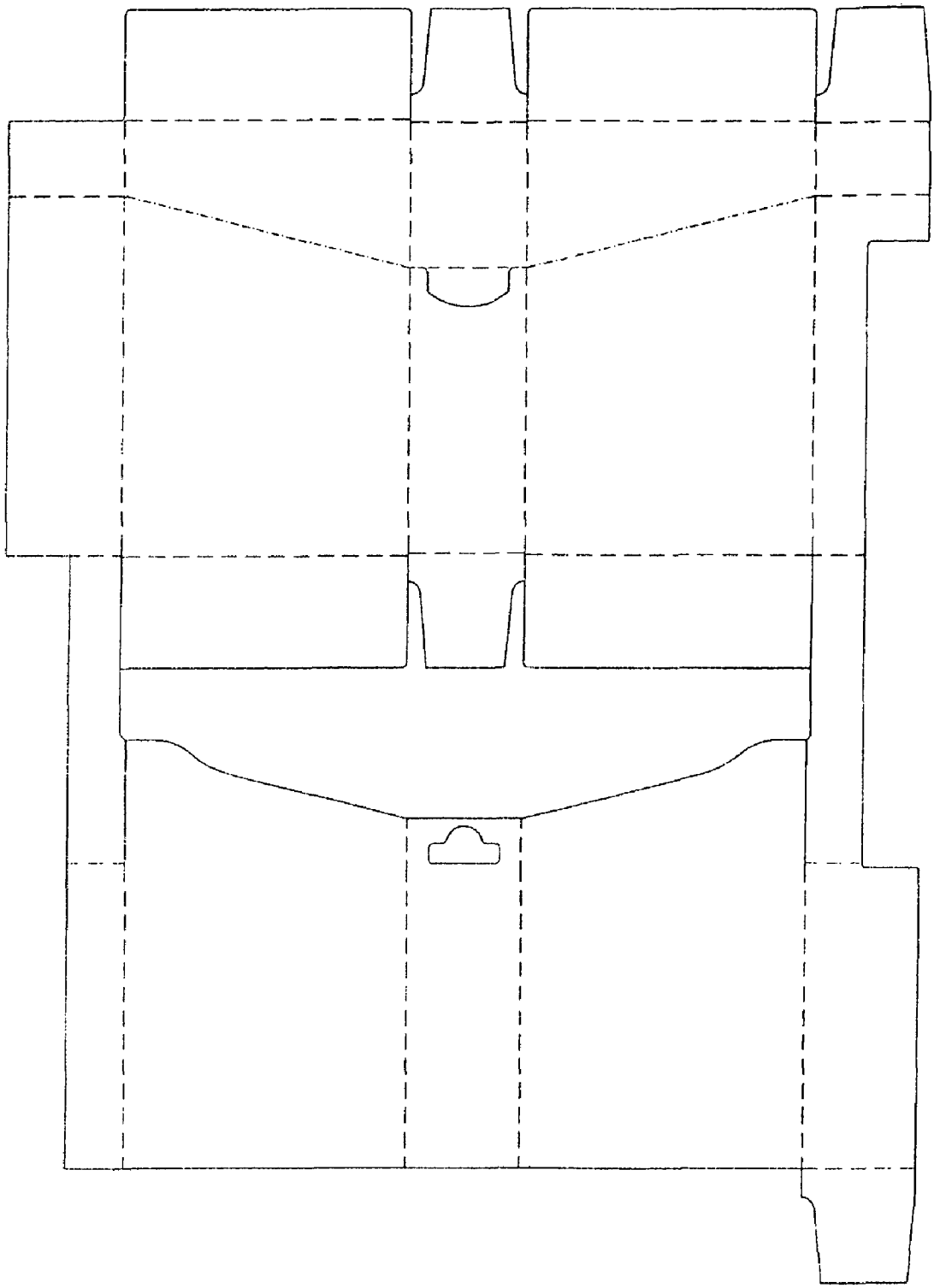

Minor tabs 28*b* connected to panel 8" and to connecting panel 40 are useful in improving the stability and closure of package 3 (i.e. preventing parts of the inner sheet of packing material from being visible from outside package 3), but, in alternative embodiments, may be eliminated (as shown in FIGS. 39, 42 and 45).

Figure 46:
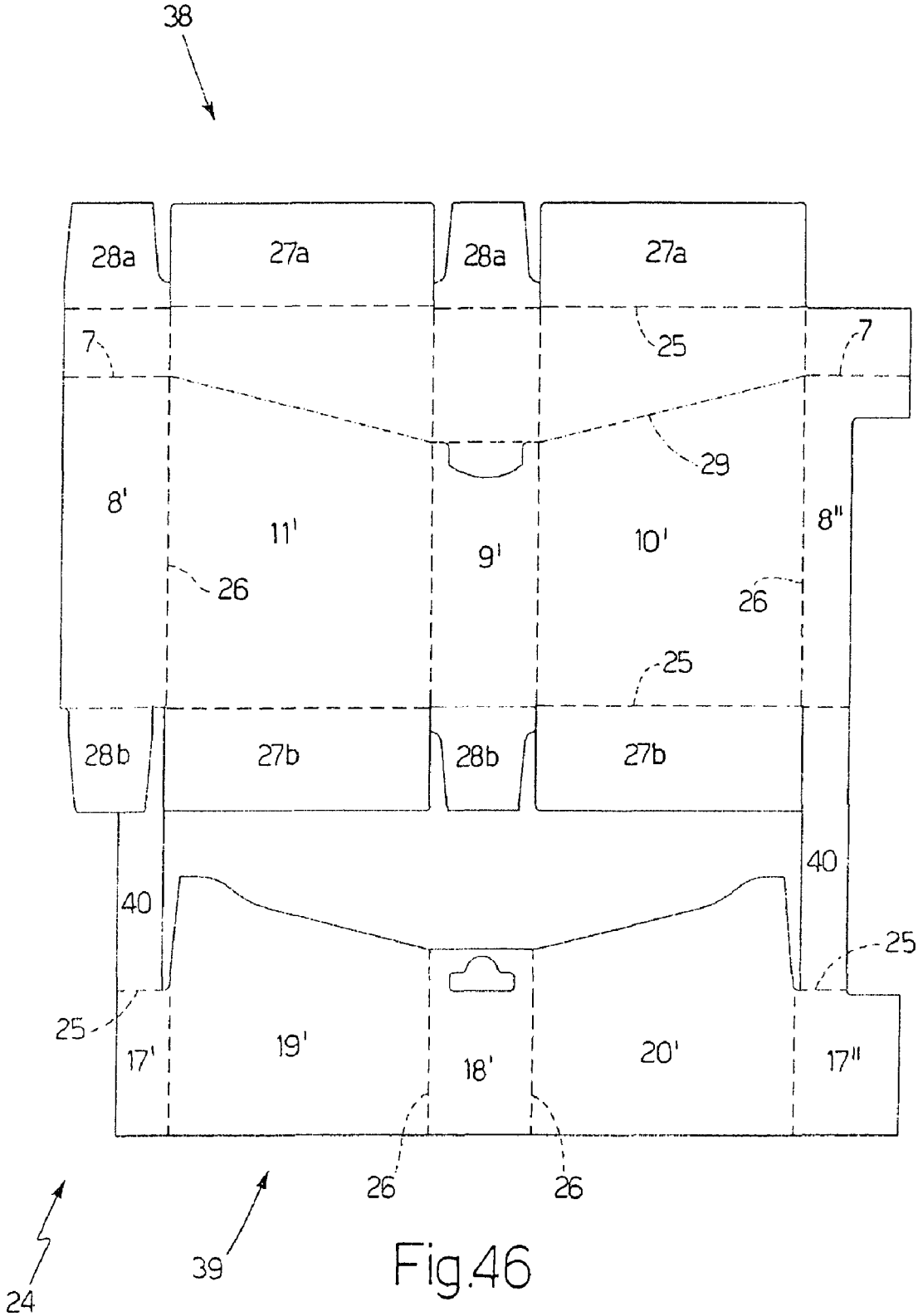
Figure 47:
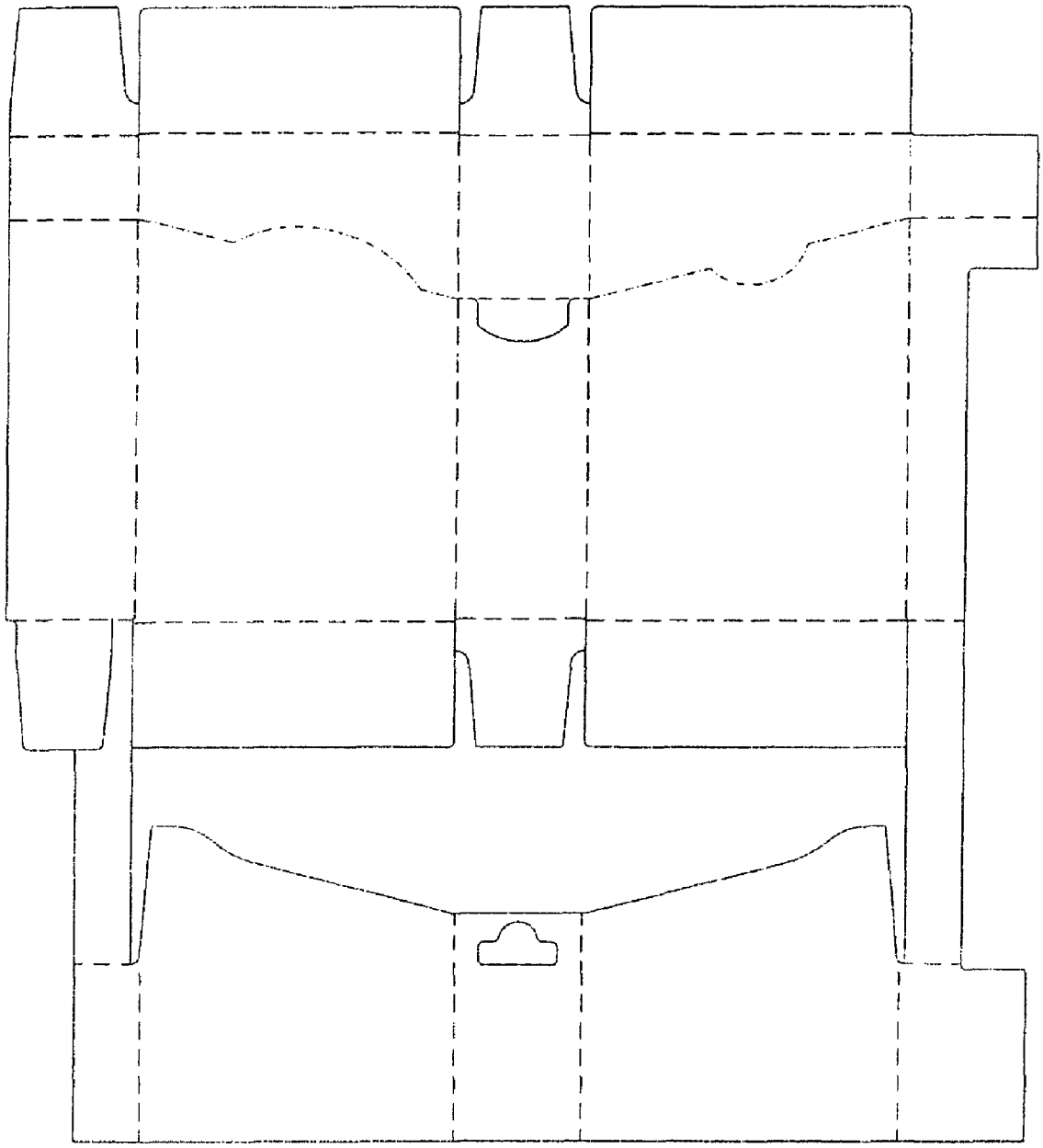
Figure 48:
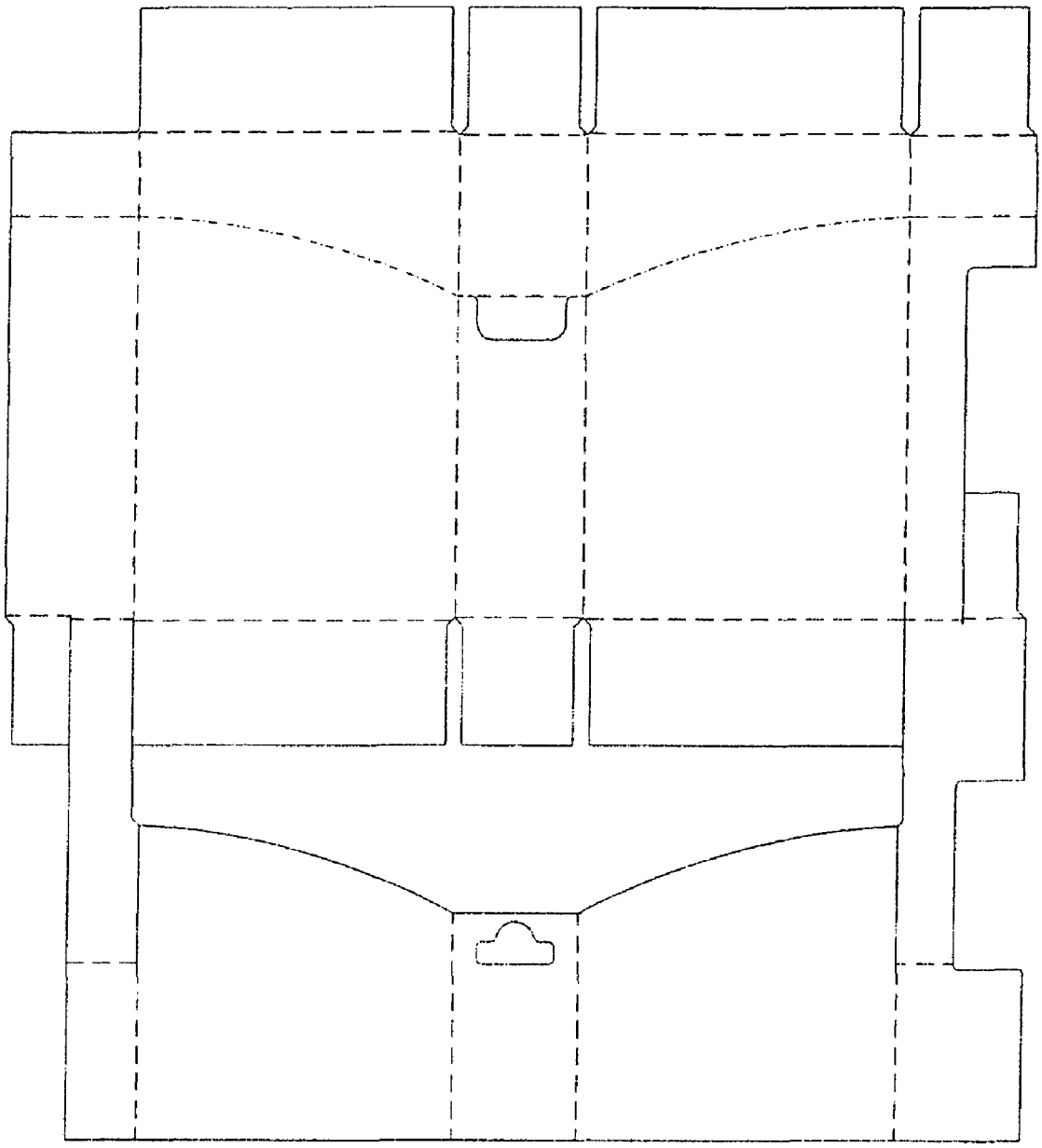

In a further embodiment shown in FIGS. 46 and 47, the minor tab 28*b* connected to panel 8' may be only slightly narrower than panel 8', so the corresponding connecting panel 40 is extremely narrow close to panel 8'.

The blanks 24 in FIGS. 51-56 each comprise a main body 38 for forming outer package 3 and substantially the same design as blanks 24 in FIGS. 5 and 8-30; and an end appendix 39 for forming collar 16, and which is located alongside main body 38 and connected to main body 38 by one connecting panel 40.

Figure 51:
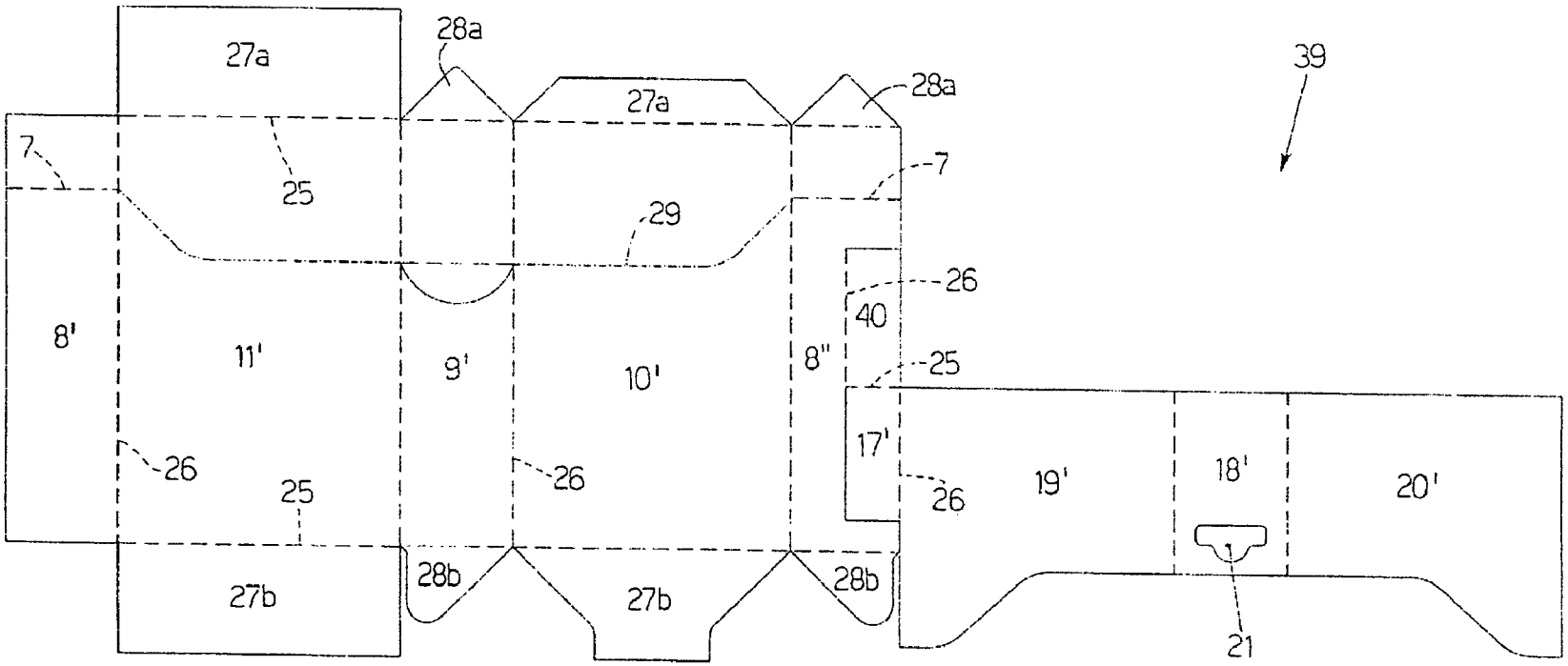
Figure 52:
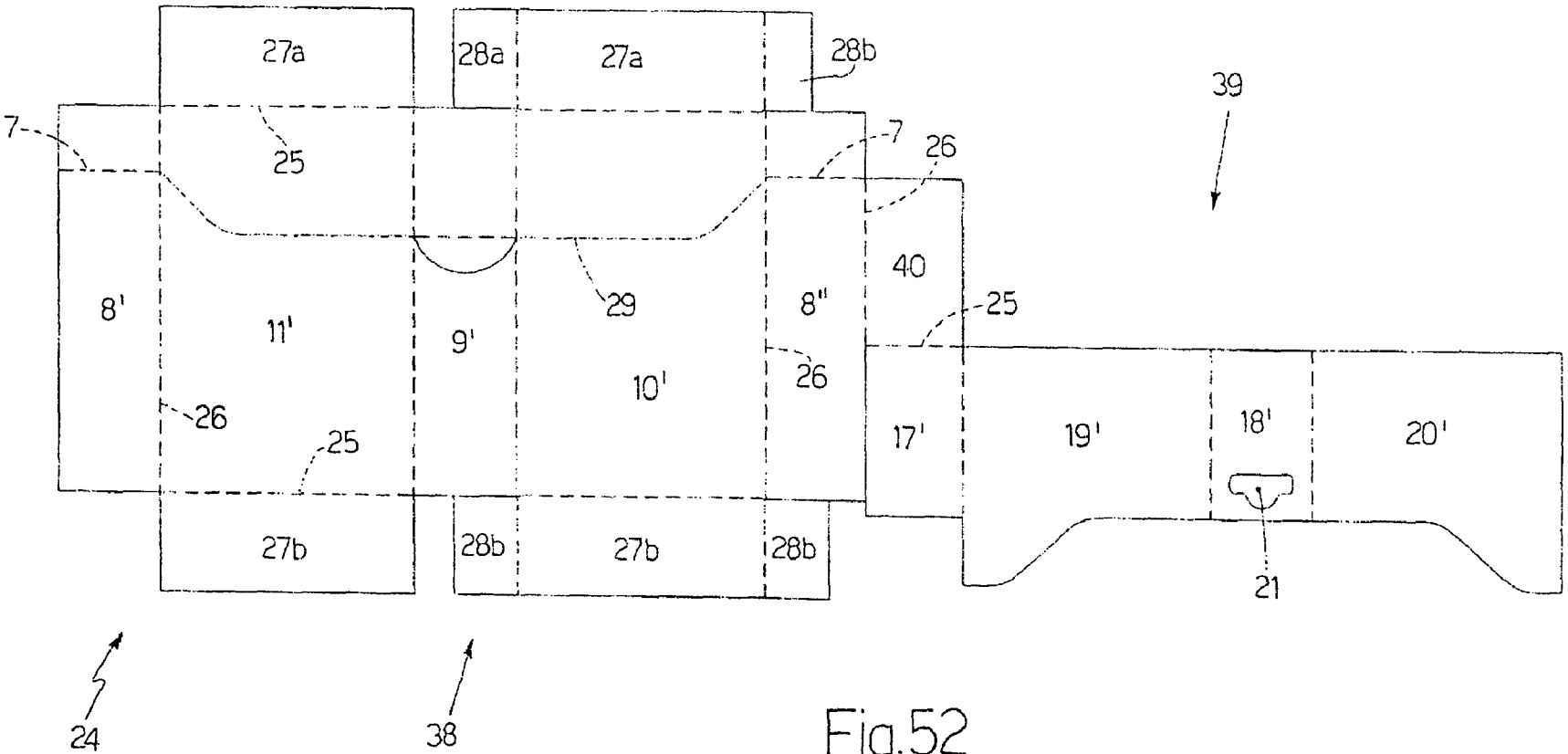

With reference to FIG. 51, main body 38 of blank 24 comprises two transverse fold lines 25, and a number of longitudinal fold lines 26 defining, between the two transverse fold lines 25, a panel 8' defining an inner portion of minor lateral wall 8 of outer package 3; a panel 11' defining major lateral wall 11 of outer package 3; a panel 9' defining minor lateral wall 9 of outer package 3; a panel 10' defining major lateral wall 10 of outer package 3; and a panel 8" defining an outer portion of minor lateral wall 8 of outer package 3.

Panels 10' and 11' each comprise two major tabs 27, which are located at opposite ends of panel 10', 11', are separated from panel 10', 11' by the two transverse fold lines 25, and form part of top wall 12 and bottom wall 13 respectively. More specifically, of each panel 10', 11', a major tab 27*a* forms part of top wall 12, and a major tab 27*b* forms part of bottom wall 13.

Panels 9' and 8" each comprise two minor tabs 28, which are located at opposite ends of panel 9', 8", are separated from panel 9', 8" by the two transverse fold lines 25, and form part of top wall 12 and bottom wall 13 respectively. More specifically, of each panel 9', 8", a minor tab 28*a* forms part of top wall 12, and a minor tab 28*b* forms part of bottom wall 13.

With reference to FIG. 51, end appendix 39 of blank 24 comprises a number of longitudinal fold lines 26, which define a panel 17' forming minor lateral wall 17 of collar 16; a panel 19' forming major wall 19 of collar 16; a panel 18' forming minor wall 18 of collar 16; and a panel 20' forming major wall 20 of collar 16.

Connecting panel 40 is hinged along a first side to panel 8" along a longitudinal fold line 26, and is hinged along a second side, perpendicular to the first side, to panel 17' along a transverse fold line 25. In an equivalent embodiment not shown, connecting panel 40 is hinged along a first side to panel 8" along a transverse fold line 25, and is hinged along a second side, perpendicular to the first side, to panel 17' along a longitudinal fold line 26.

When folding blank 24, connecting panel 40 is first rotated 180° about transverse fold line 25 and with respect to panel 17', and is then rotated 180° about longitudinal fold line 26 and with respect to panel 8", so that end appendix 39 of blank 24 is rotated 180° onto main body 38 of blank 24. It is important to note that blank 24 has a printed face and a nonprinted face, and connecting panel 40 is folded as described above so that the printed face of collar 16 contacts the nonprinted face of outer package 3 and so faces outwards of the assembled packet 1 of cigarettes.

As shown in the drawings, connecting panel 40 and panel 17' are aligned longitudinally (i.e. in a direction parallel to longitudinal fold lines 26).

Figure 53:
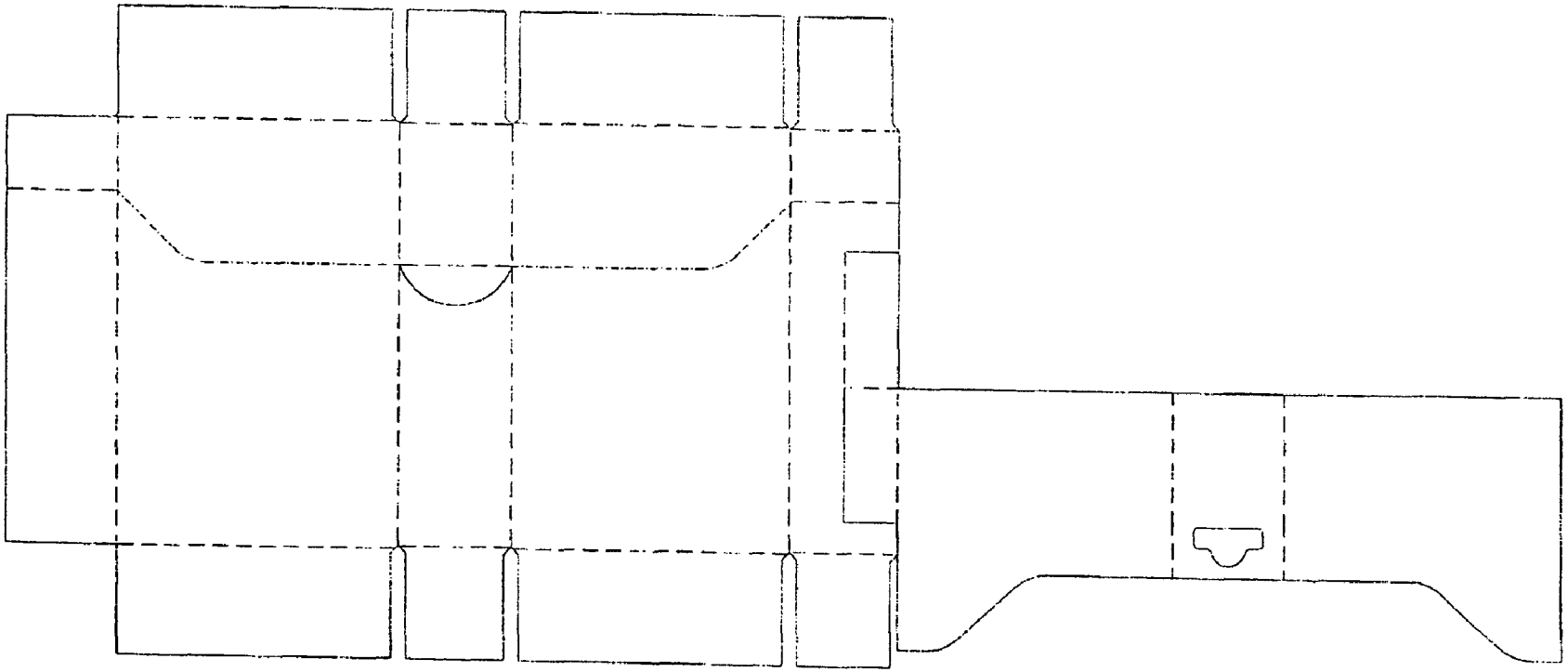
Figure 54:
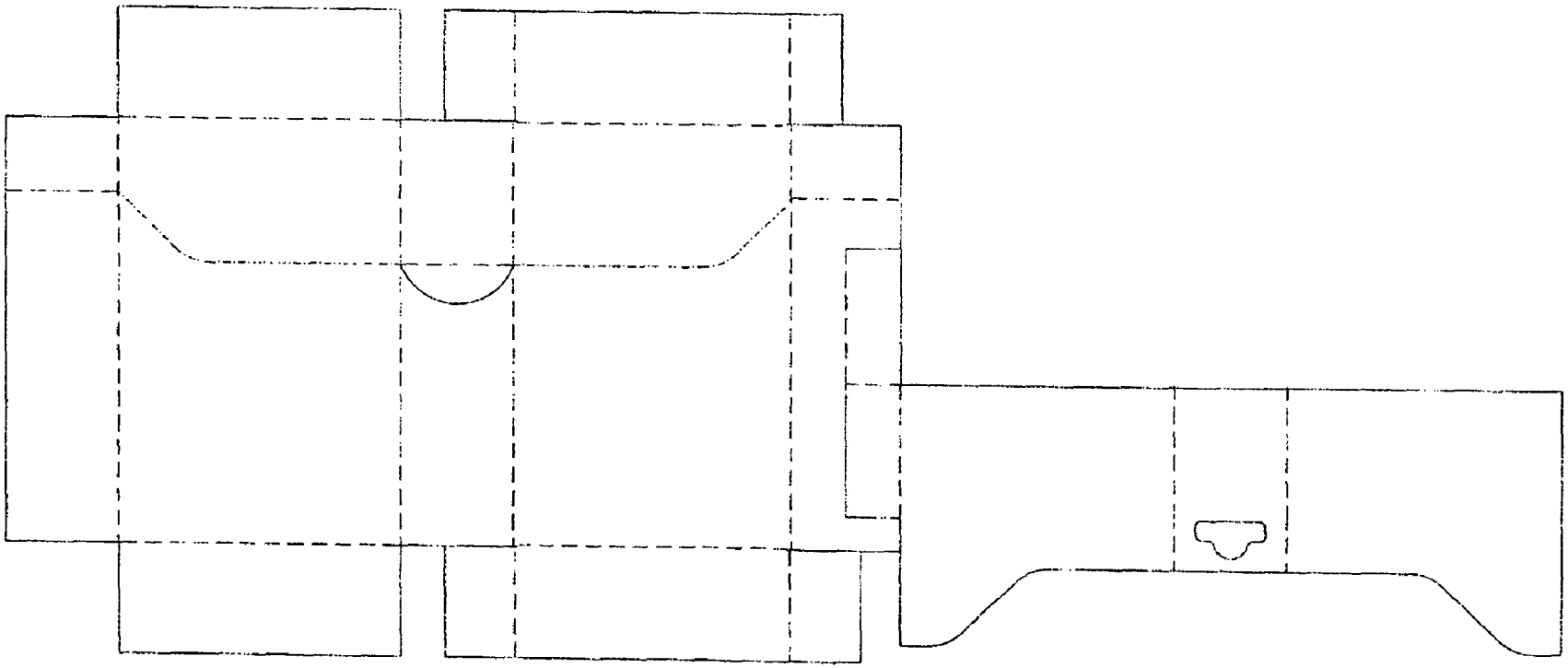
Figure 55:
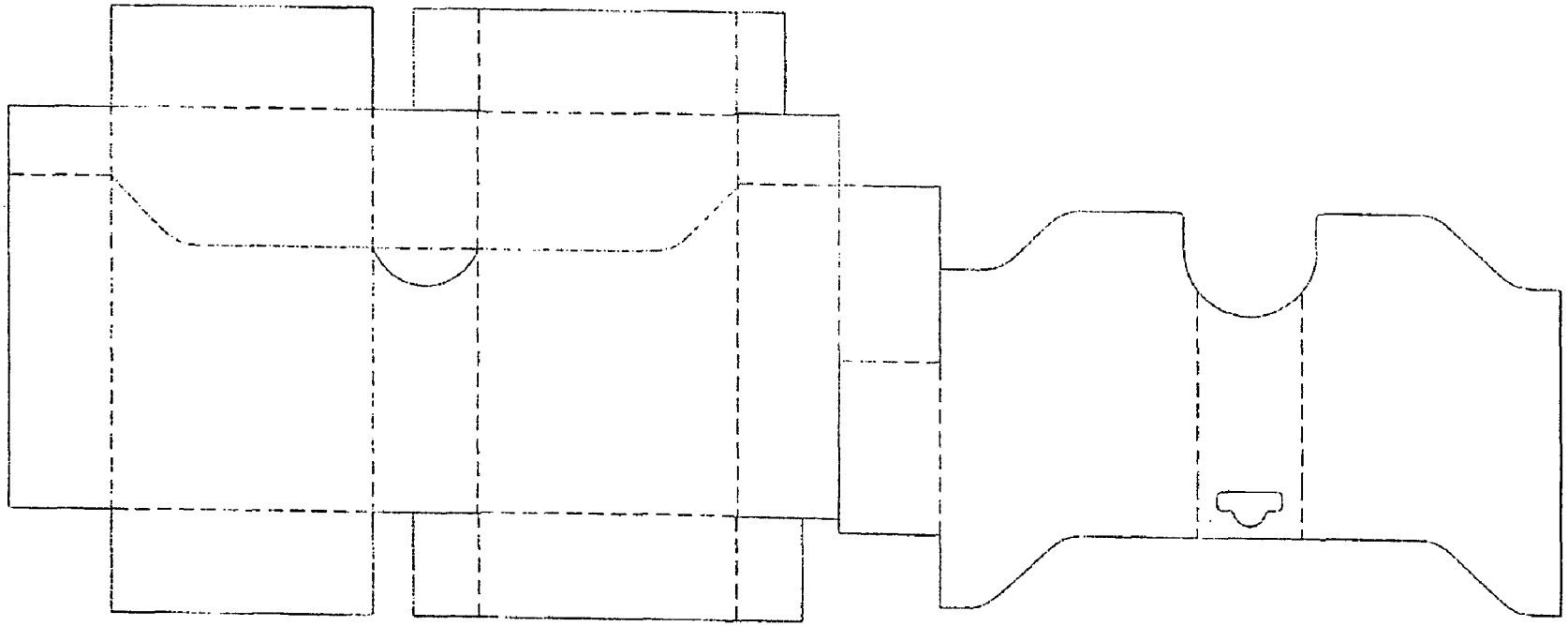

In the embodiment shown in FIGS. 51, 53 and 54, panel 8" is C-shaped with a central hole, in which both connecting panel 40 and panel 17' are formed. In the embodiments shown in FIGS. 52, 55 and 56, panel 8" is rectangular, and connecting panel 40 is located between panel 8" and panel 19'.

In a preferred embodiment, lateral walls 17, 18, 19, 20 of collar 16 are narrower (measured parallel to transverse fold lines 25) than the corresponding lateral walls 8, 9, 10, 11 of outer package 3. More specifically, each lateral wall 17, 18, 19, 20 of collar 16 is narrower than a corresponding lateral wall 8, 9, 10, 11 of outer package 3 by an amount equal to twice the thickness of blank 24. This difference in size between collar 16 and outer package 3 is due to the outer perimeter being greater than the inner perimeter (collar 16, in fact, is housed entirely inside outer package 3), and, without it, the lateral walls 17, 18, 19, 20 of collar 16 would deform when inserted inside outer package 3, thus resulting in both aesthetic and functional impairment (greater difficulty in folding blank 24, possible jamming of lid 6 against collar 16 when closing the lid, and a reduction in the mechanical strength of packet 1 of cigarettes as a whole).

Obviously, the above difference in the width of lateral walls 17, 18, 19, 20 of collar 16 with respect to the corresponding lateral walls 8, 9, 10, 11 of outer package 3 is also reflected in blanks 24. For each blank 24, therefore, panels 17', 17", 18', 19', 20' of end appendix 39 are narrower (measured parallel to transverse fold lines 25) than the corresponding panels 8', 8", 9', 10', 11' of main body 38. More specifically, each lateral wall 17, 18, 19, 20 of collar 16 is narrower than a corresponding lateral wall 8, 9, 10, 11 of outer package 3 by an amount equal to twice the thickness of blank 24.

As stated, the front wall 18 of collar 16 has a horizontal slit 21; and lid 6 has a tab 22 (shown in FIG. 3), which projects inwards of lid 6 and, when lid 6 is in the closed position, releasably engages slit 21 to retain lid 6 in the closed position. In the blanks 24 in FIGS. 8-23, 25-48 and 51-55, tab 22 is formed by making a crescent-shaped cut in panel 9'. Whereas, in the blanks 24 in FIGS. 49, 50 and 56, tab 22 is hinged along a transverse fold line 25 to a connecting tab 41 initially connected to minor lateral wall 18 of collar 16 (i.e. to panel 18' of end appendix 39 of blank 24) along a tear line 42.

When folding blank 24, tab 22 is first folded 180° about transverse fold line 25 onto connecting tab 41; connecting tab 41 is then folded 180° about tear line 42 onto minor lateral wall 18 of the collar (i.e. onto panel 18' of end appendix 39 of blank 24); and, when collar 16 (i.e. end appendix 39 of blank 24) is applied to outer package 3 (i.e. to main body 38 of blank 24), connecting tab 41 is glued to an inner surface of minor lateral wall 9 of outer package 3 (i.e. of panel 9' of main body 38 of blank 24) at the edge of lid 6, so that tab 22 is partly inserted inside slit 21.

Figure 24:
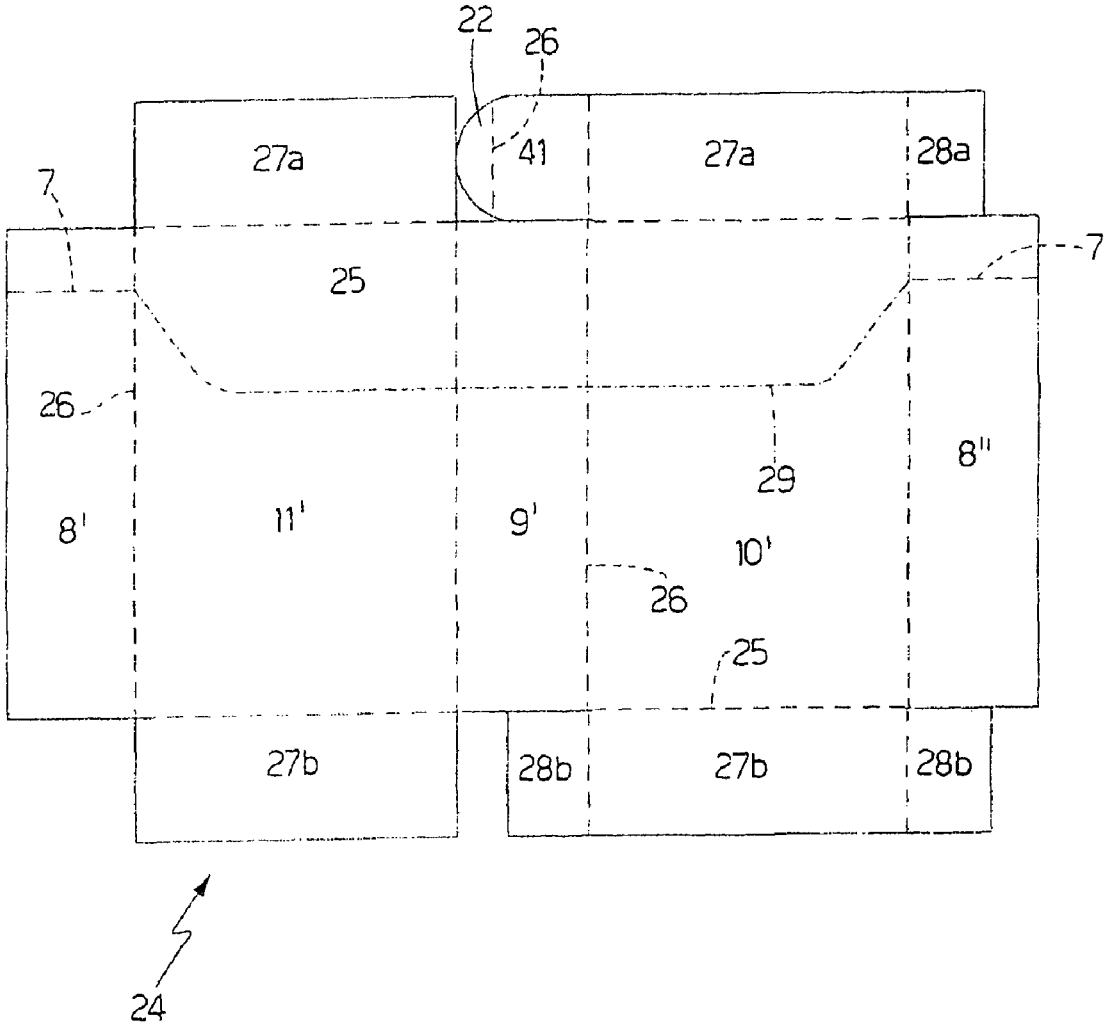
Figure 25:
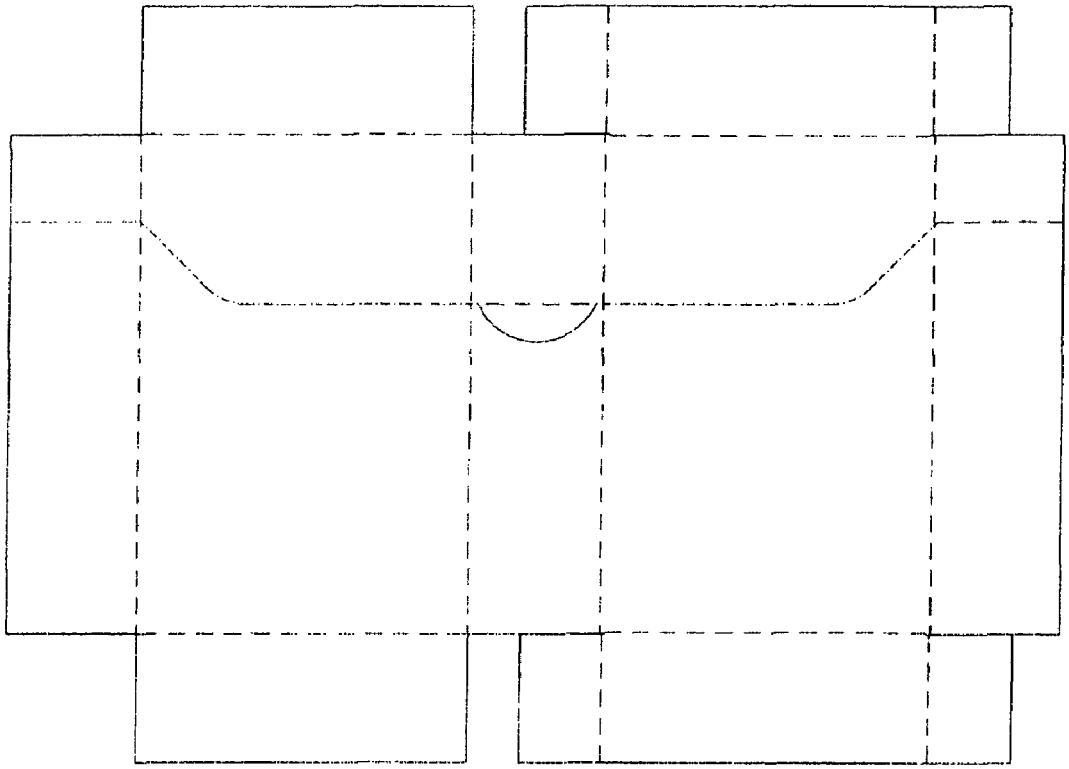
Figure 26:
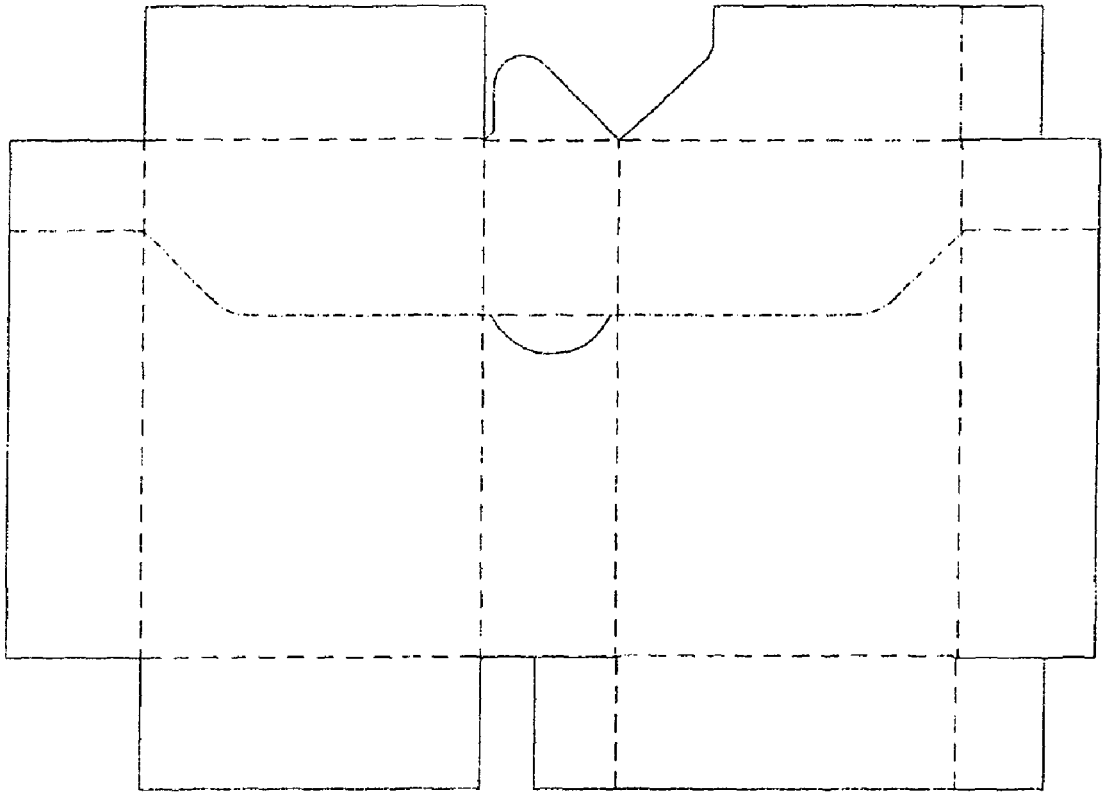

FIG. 24 shows a different embodiment of blank 24, in which connecting tab 41 is connected to a major tab 27*a* along a longitudinal fold line 26, and is connected to tab 22 along a further longitudinal fold line 26. In which case, when folding blank 24, tab 22 is first folded 180° about longitudinal fold line 26 onto connecting tab 41; and connecting tab is then folded 90° about longitudinal fold line 26 and glued to the inner surface of minor lateral wall 9 of outer package 3 (i.e. of panel 91 of blank 24).

Figure 49:
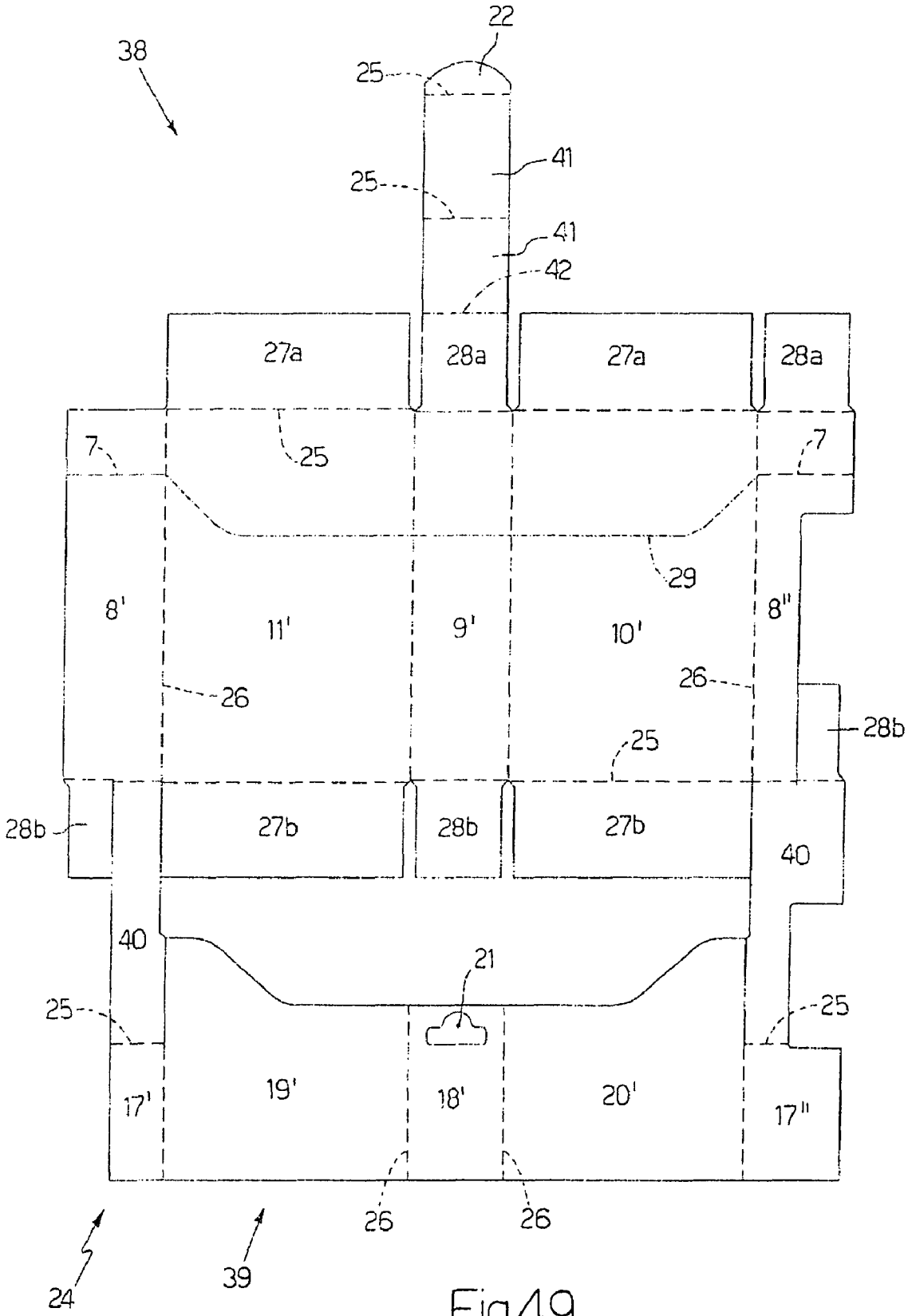
Figure 50:
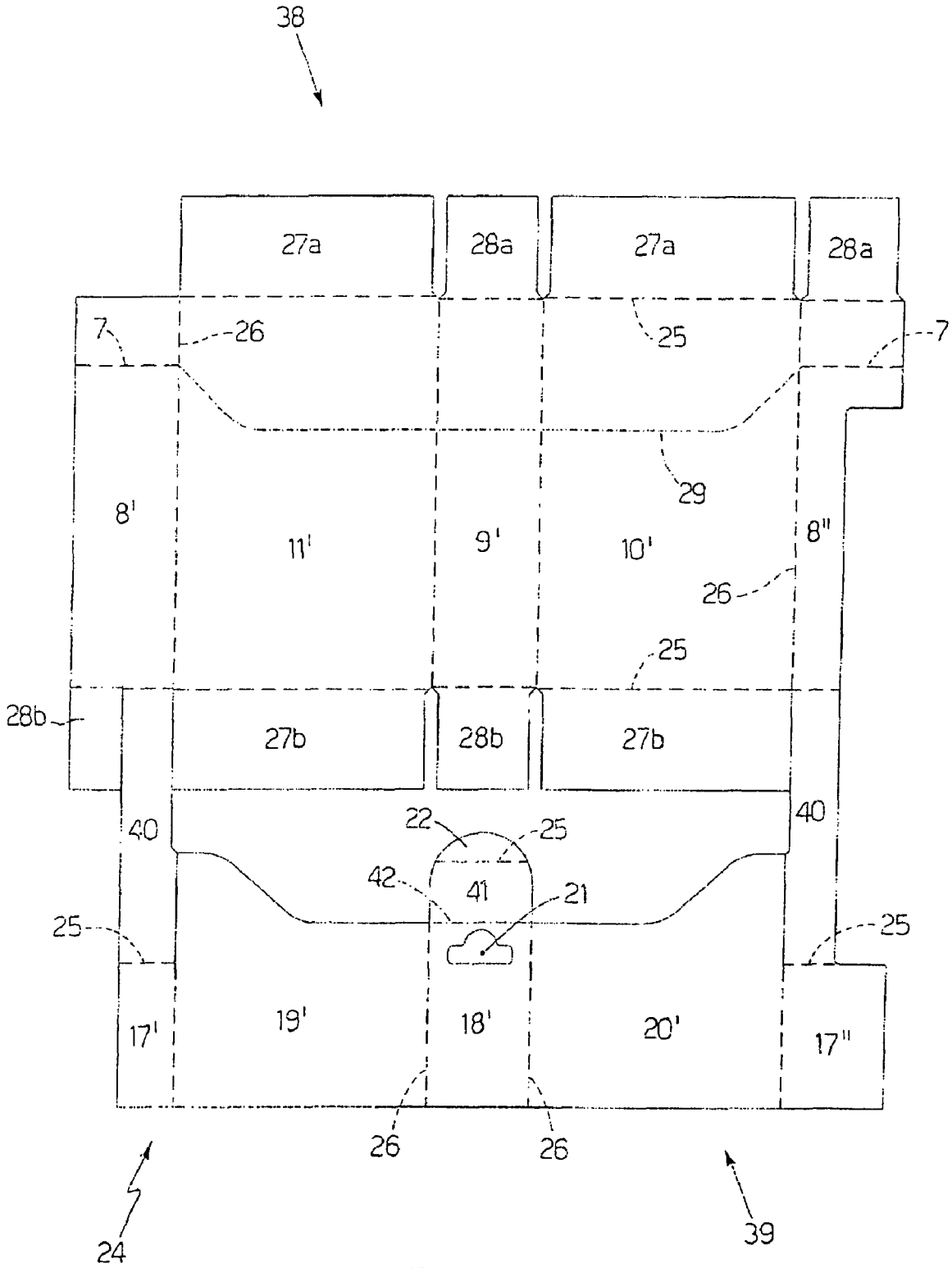

FIG. 49 shows a further embodiment of blank 24, which comprises two successive connecting tabs 41 connected, as of panel 9' of blank 24, along a transverse fold line 25. In which case, when folding blank 24, tab 22 is first folded 180° about a transverse fold line 25 onto a first connecting tab 41; and the two connecting tabs 41 are then folded and glued to each other, are then folded together 180° about a transverse fold line 25, and are glued to the inner surface of minor lateral wall 9 of outer package 3 (i.e. of panel 9' of blank 24).

A collar 16 comprising connecting tab 41 and tab 22 is also shown in FIG. 28*a*.

The first time lid 6 is opened, the force required to extract tab 22 from the slit normally tears tear line 42, thus detaching connecting tab 41 and tab 22 from collar 16.

Figure 56:
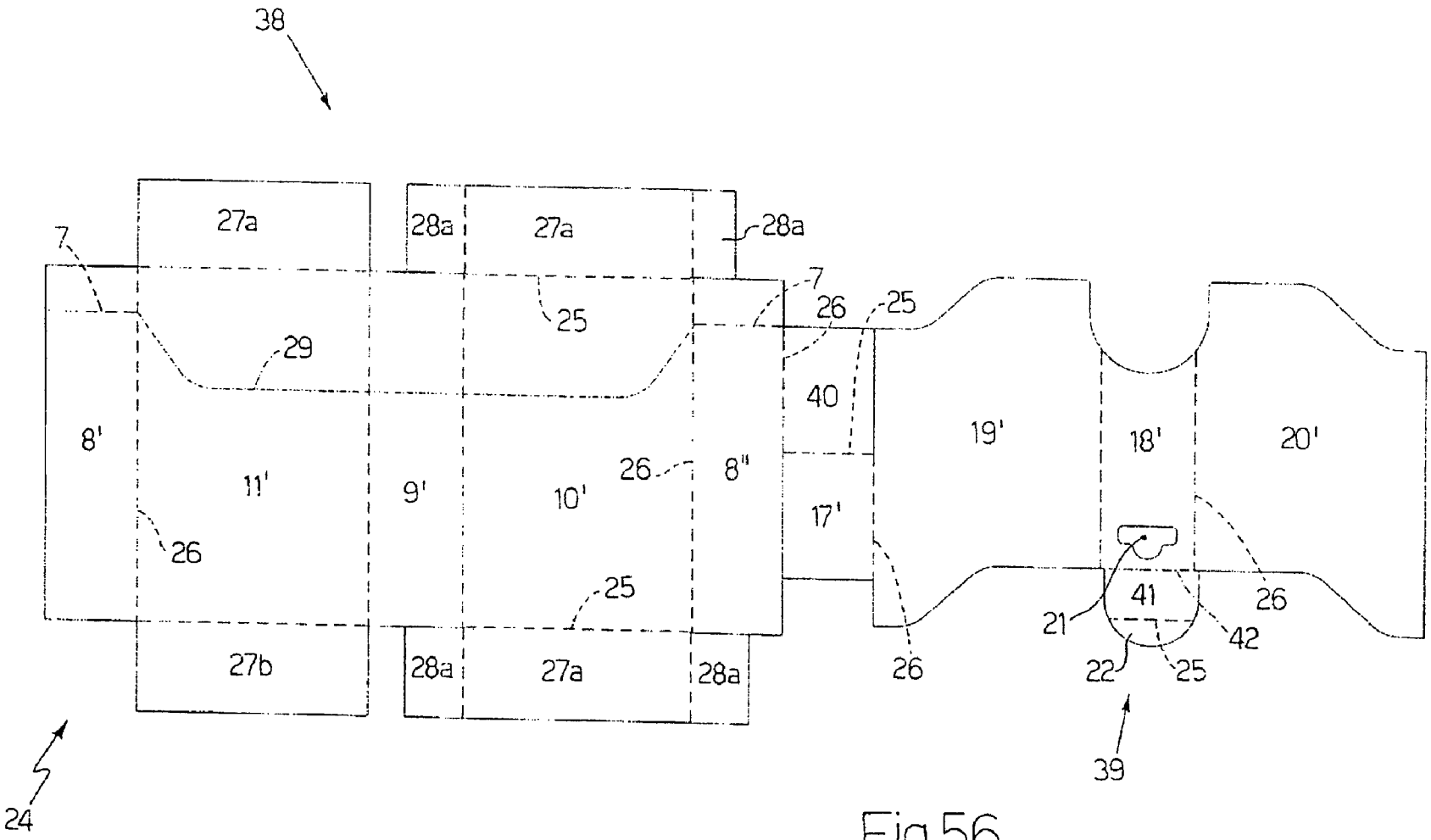

It is interesting to note how, in the FIG. 56 embodiment, connecting tab 41 and, hence, tab 22 are slightly offset with respect to panel 18'. Only in this way, in fact, can tab 22 be positioned correctly with respect to panel 9' of main body 38 of blank 24, on account of panels 17', 18', 19', 20' of end appendix 39 of blank 24 (as described in detail above) being narrower (measured parallel to transverse fold lines 25) than the corresponding panels 8', 8", 9', 10', 11' of main body 38.

Given its numerous advantages, the design of packet 1 of cigarettes as described above may also be applied integrally to the manufacture of a carton of packets of cigarettes (both rigid and soft), which is substantially the same as packet 1 described above, except that it contains packets, as opposed to a group, of cigarettes.

The invention claimed is:

1. A method of producing a package of tobacco articles;

the package (1) of tobacco articles comprises a group (2) of tobacco articles wrapped in a tubular inner sheet of packing material closed axially by two end folds; and an outer package (3), which is formed by folding a blank (24), surrounds the group (2) of tobacco articles, is parallelepiped-shaped, and comprises a top wall (12) contacting a first end fold of the inner sheet of packing material, a bottom wall (13) parallel to the top wall (12) and contacting a second end fold of the inner sheet of packing material, and a number of lateral walls (8, 9, 10,11) perpendicular to the top wall and bottom wall (12, 13);

the blank (24) has two transverse fold lines (25), and a number of longitudinal fold lines (26) defining, between the two transverse fold lines (25), a first panel (8') forming part of a first minor lateral wall (8); a second panel (11') forming a first major lateral wall (11); a third panel (9') forming a second minor lateral wall (9); a fourth panel (10') forming a second major lateral wall (10); and a fifth panel (8") forming the rest of the first minor lateral wall (8);

the second and fourth panel (10', 11') each comprise two major tabs (27), which are located at opposite ends of the second or fourth panel (10', 11'), are separated from the second or fourth panel (10', 11') by the two transverse fold lines (25), and form part of the bottom wall and top wall (13, 12) respectively;

the third and fifth panel (9', 8") each comprise two minor tabs (28), which are located at opposite ends of the third or fifth panel (9', 8"), are separated from the third or fifth panel (9', 8") by the two transverse fold lines (25), and form part of the bottom wall and top wall (13, 12) respectively;

a first major tab (27*a*) forming part of the top wall (12) is the same shape and size as the top wall (12) ; and a second major tab (27*a*) forming part of the top wall (12), and the minor tabs (28*a*) forming part of the top wall (12) are less than half the height of the first major tab (27*a*);

and the method comprises the steps of:

folding the inner sheet of packing material into a tube about the group (2) of tobacco articles, leaving two open ends;

folding the blank (24) into a tube about the group (2) of tobacco articles and on top of the previously folded inner sheet of packing material;

folding a first open end (30) of the inner sheet of packing material together with the major tabs (27*a*) and minor tabs (28*a*) forming part of the top wall (12), and folding a second open end (31) of the inner sheet of packing material together with the major tabs (27*b*) and minor tabs (28*b*) forming part of the bottom wall (13).

2. A method as claimed in claim 1, wherein:

the first major tab (27*a*) is rectangular;

the second major tab (27*a*) is in the form of an isosceles trapezium with the major base coincident with a transverse fold line (25); and the minor tabs (28*a*) forming part of the top wall (12) are each in the form of an isosceles triangle, so as not to overlap the second major tab (27*a*) when folding the blank (24).

3. A method as claimed in claim 1, wherein:

a third major tab (27*b*) forming part of the bottom wall (13) is the same shape and size as the bottom wall (13); and a fourth major tab (27*b*) forming part of the bottom wall (13) is the same height as the third major tab (27*b*).

4. A method as claimed in claim 3, wherein:

the third major tab (27*b*) is rectangular; and the fourth major tab (27*b*) is of composite shape comprising abase in the form of an isosceles trapezium with the major base coincident with a transverse fold line (25), and a rectangular appendix (39).

5. A method as claimed in claim 4, wherein the minor tabs (28*b*) forming part of the bottom wall (13) are each in the form of a right triangle, so as not to overlap the fourth major tab (27*b*) when folding the blank (24).

6. A method as claimed in claim 3, wherein:

the third major tab (27*b*) and fourth major tab (27*b*) are each substantially in the form of an isosceles trapezium with the major base coincident with a transverse fold line (25); and the minor tabs (28*b*) forming part of the bottom wall (13) are each substantially in the form of an isosceles trapezium with the major base coincident with a transverse fold line (25).

7. A method as claimed in claim 1, wherein the outer package (3) comprises a cup-shaped container (4) having an open top end (5); and a cup-shaped lid (6) hinged to the container (4) along a hinge (7) to rotate, with respect to the container (4), between an open position and a closed position opening and closing the open top end (5) respectively.

8. A method as claimed in claim 7, wherein the hinge (7) is located on a lateral wall (8) of the outer package (3).

9. A method as claimed in claim 7, wherein the outer package (3) has a rectangular cross section, and comprises two opposite parallel major lateral walls (10, 11), and two opposite parallel minor lateral walls (8, 9); and the hinge (7) is located on a minor lateral wall (8) of the outer package (3).

10. A method as claimed in claim 7, and comprising a substantially transverse tear line (29) separating the container (4) and the lid (6).

11. A method as claimed in claim 1, wherein folding the blank (24) to form the top wall (12) comprises the steps of:

folding the minor tabs (28*a*), forming part of the top wall (12), and the corresponding portions (32) of the inner sheet of packing material together onto the group (2) of tobacco articles;

folding the second major tab (27*a*) and the corresponding portion (33) of the inner sheet of packing material together onto the group (2) of tobacco articles;

folding the first major tab (27*a*) and the corresponding portion (34) of the inner sheet of packing material together onto the group (2) of tobacco articles and on top of the previously folded second major tab and minor tabs (28*a*), so that the corresponding portion (34) of the inner sheet of packing material does not overlap the second major tab (27*a*) and the minor tabs (28*a*).

12. A method as claimed in claim 1, wherein:

a third major tab (27*b*) forming part of the bottom wall (13) is the same shape and size as the bottom wall (13); and a fourth major tab (27*b*) forming part of the bottom wall (13) is the same height as the third major tab (27*b*);

and folding the blank (24) to form the bottom wall (13) comprises the steps of:

folding the minor tabs (28*b*), forming part of the bottom wall (13), and the corresponding portions (35) of the inner sheet of packing material together onto the group (2) of tobacco articles;

folding the fourth major tab (27*b*) and the corresponding portion (36) of the inner sheet of packing material together onto the group (2) of tobacco articles;

folding the third major tab (27*b*) and the corresponding portion (37) of the inner sheet of packing material together onto the group (2) of tobacco articles and on top of the previously folded fourth major tab and minor tabs (28*b*), so that the corresponding portion (37) of the inner sheet of packing material overlaps the fourth major tab (27*b*) and the minor tabs (28*b*).

* * * * *